US006192861B1

(12) United States Patent
Hamada et al.

(10) Patent No.: US 6,192,861 B1
(45) Date of Patent: Feb. 27, 2001

(54) ENGINE IGNITION DEVICE

(75) Inventors: Mikio Hamada; Satomi Wada, both of Handa (JP)

(73) Assignee: Aisan Kogyo Kabushiki Kaisha, Aichi (JP)

( * ) Notice: Subject to any disclaimer, the term of this patent is extended or adjusted under 35 U.S.C. 154(b) by 0 days.

(21) Appl. No.: 09/209,179

(22) Filed: Dec. 10, 1998

(30) Foreign Application Priority Data

Dec. 11, 1997 (JP) ..... 9-341439
Dec. 26, 1997 (JP) ..... 9-360266
Dec. 11, 1997 (JP) ..... 9-362122

(51) Int. Cl.[7] ..... F02P 5/15
(52) U.S. Cl. ..... 123/406.61; 123/617; 123/149 D
(58) Field of Search ..... 123/406.58, 406.59, 123/406.61, 609, 612, 617, 149 D

(56) References Cited

U.S. PATENT DOCUMENTS 4,296,471 * 10/1981 Goux ..... 123/406.61
4,385,605 * 5/1983 Petrie et al. ..... 123/406.61
4,796,208 * 1/1989 Kumagai et al. ..... 123/406.61
4,907,178 * 3/1990 Ogawa et al. ..... 123/406.61
4,966,116 * 10/1990 Hidetoshi ..... 123/617

FOREIGN PATENT DOCUMENTS 5-156980 6/1993 (JP) .
7-91354 4/1995 (JP) .
8-312512 11/1996 (JP) .

* cited by examiner

*Primary Examiner*—Willis R. Wolfe
(74) *Attorney, Agent, or Firm*—Finnegan, Henderson, Farabow, Garrett & Dunner, L.L.P.

(57) ABSTRACT

In an ignition device for an engine 1, a spark plug 14 is operated to emit sparks with respect to the fuel-air mixture, so that the fuel-air mixture is ignited. A protrusion 19 provided on a flywheel 6 mounted on a crankshaft 5 is revolved with the rotation of the crankshaft 5. A magnet pickup 21 detects the passage of the protrusion 19. When the protrusion 19 passes near the magnet pickup 21, the magnet pickup 21 outputs a detection signal, in a pulse manner, having a peak value in response to the passing speed of the protrusion. When the detection signal outputted from the magnet pickup 21 exceeds a predetermined threshold value, the electronic control unit (ECU) 18 operates to activate the spark plug 14 through an ignition coil 15 so that the ignition timing is advanced or delayed in accordance with the difference in rotational speed of the shaft 5, i.e., of the engine 1.

17 Claims, 24 Drawing Sheets

DETECTION SIGNAL OF SECOND MAGNET PICK UP (MPU)
Vp

RECTIFIED SIGNAL OF SECOND DIODE
Vp
Vth

OUTPUT SIGNAL OF SECOND INVERTOR
HIGH
LOW

DETECTION SIGNAL OF FIRST MPU
Vp

RECTIFIED SIGNAL OF FIRST DIODE
Vp
Vth

OUTPUT SIGNAL OF FIRST INVERTOR
HIGH
LOW

APPLICATION OF CURRENT TO IGNITION COIL
ON
OFF

IGNITION OF IGNITION PLUG
ON
OFF
→ (TIME)

INPUT SIGNAL OF SECOND OPERATIONAL AMPLIFIER

INPUT SIGNAL OF RESET CIRCUIT

OUTPUT OF SECOND INVERTOR

OUTPUT OF AMPLIFIER

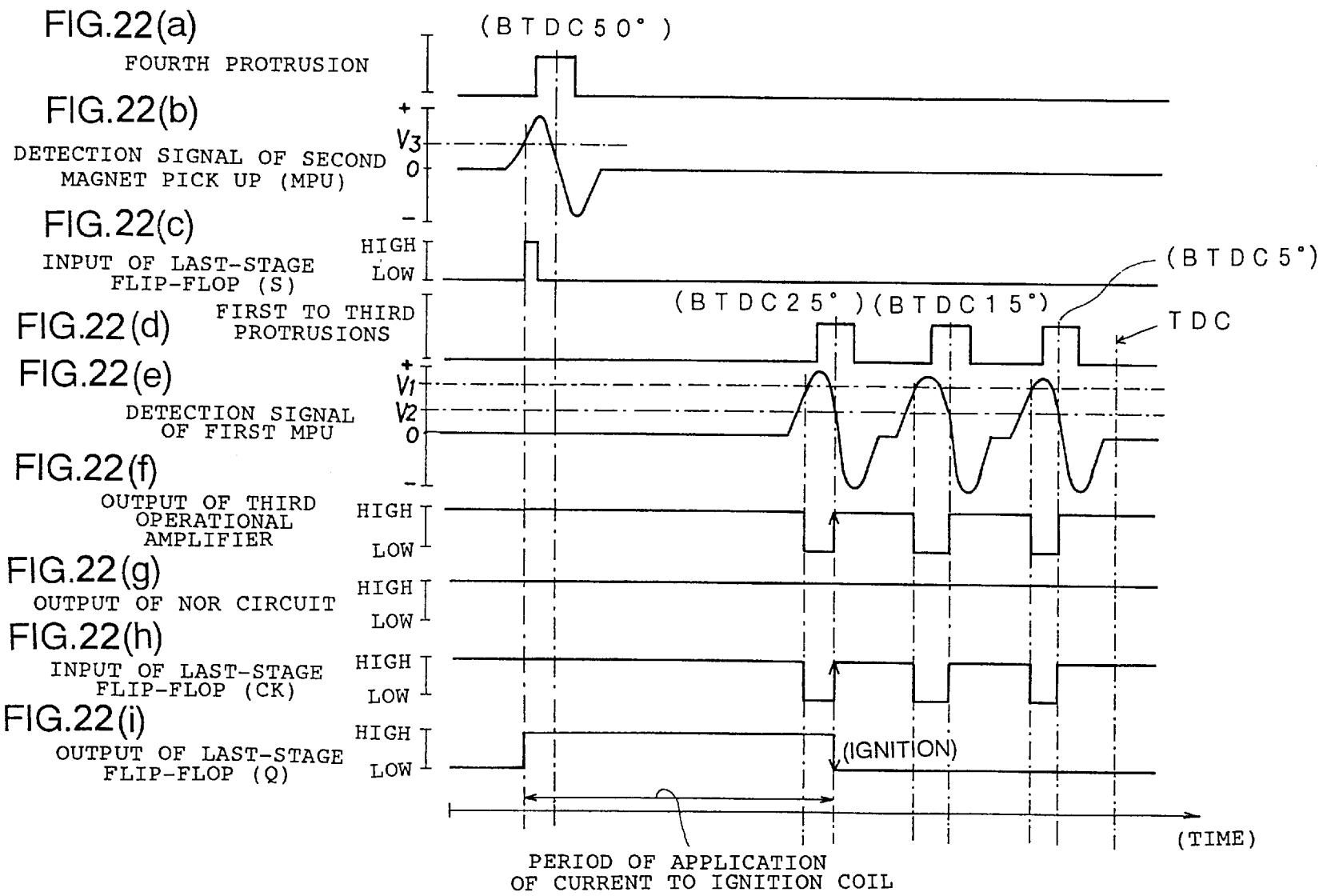
FIG.22(a)
FOURTH PROTRUSION
(BTDC50°)
FIG.22(b)
DETECTION SIGNAL OF SECOND MAGNET PICK UP (MPU)
+
V3
0
-
FIG.22(c)
INPUT OF LAST-STAGE FLIP-FLOP (S)
HIGH
LOW
(BTDC25°)
(BTDC15°)
(BTDC5°)
TDC
FIG.22(d)
FIRST TO THIRD PROTRUSIONS
FIG.22(e)
DETECTION SIGNAL OF FIRST MPU
+
V1
V2
0
-
FIG.22(f)
OUTPUT OF THIRD OPERATIONAL AMPLIFIER
HIGH
LOW
FIG.22(g)
OUTPUT OF NOR CIRCUIT
HIGH
LOW
FIG.22(h)
INPUT OF LAST-STAGE FLIP-FLOP (CK)
HIGH
LOW
FIG.22(i)
OUTPUT OF LAST-STAGE FLIP-FLOP (Q)
HIGH
LOW
(IGNITION)
(TIME)
PERIOD OF APPLICATION OF CURRENT TO IGNITION COIL

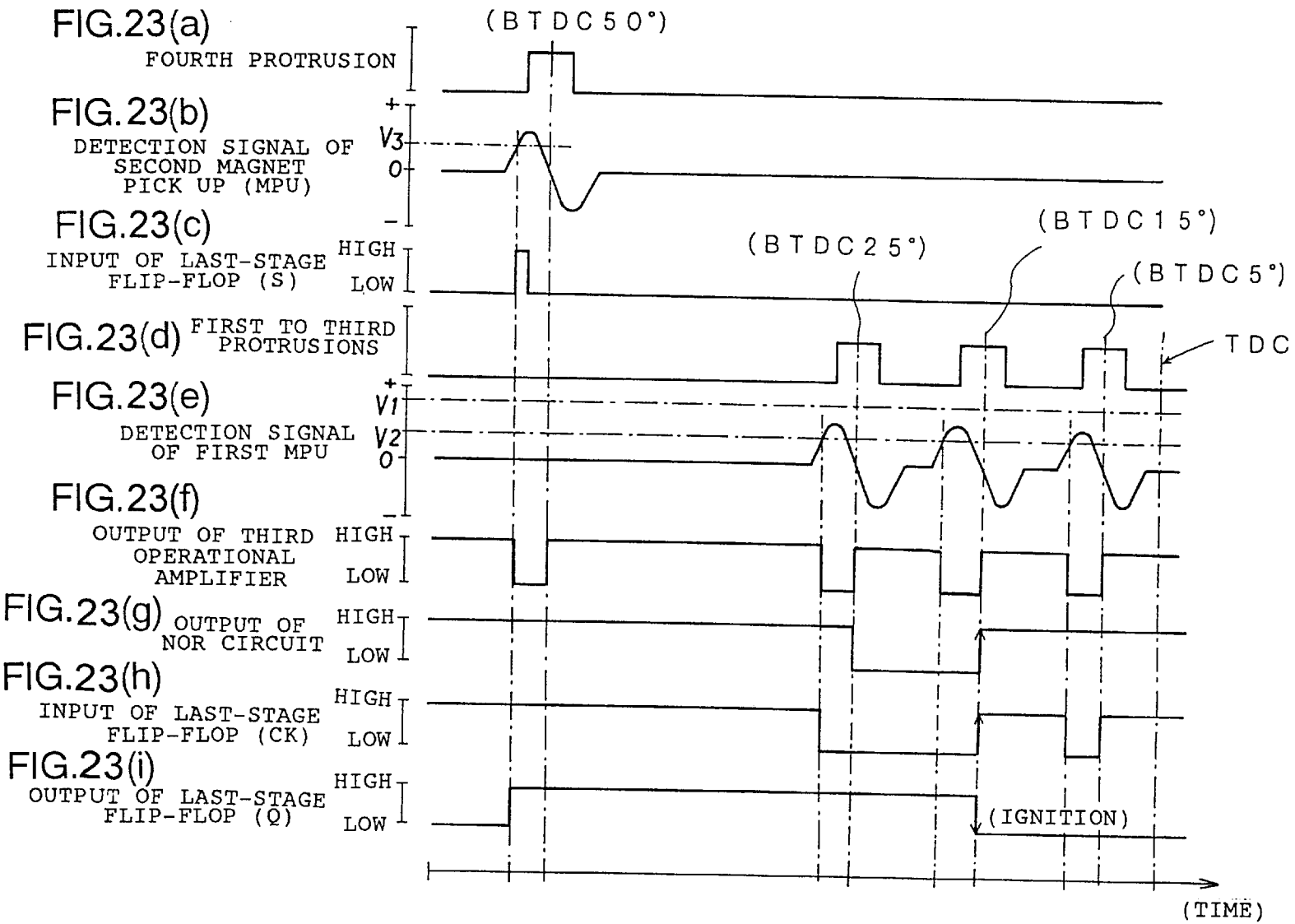
FIG.23(a) FOURTH PROTRUSION
FIG.23(b) DETECTION SIGNAL OF SECOND MAGNET PICK UP (MPU)
FIG.23(c) INPUT OF LAST-STAGE FLIP-FLOP (S)
FIG.23(d) FIRST TO THIRD PROTRUSIONS
FIG.23(e) DETECTION SIGNAL OF FIRST MPU
FIG.23(f) OUTPUT OF THIRD OPERATIONAL AMPLIFIER
FIG.23(g) OUTPUT OF NOR CIRCUIT
FIG.23(h) INPUT OF LAST-STAGE FLIP-FLOP (CK)
FIG.23(i) OUTPUT OF LAST-STAGE FLIP-FLOP (Q)
(BTDC50°)
(BTDC25°)
(BTDC15°)
(BTDC5°)
TDC
(IGNITION)
(TIME)
+
V3
0
-
HIGH
LOW
+
V1
V2
0
-
HIGH
LOW
HIGH
LOW
HIGH
LOW
HIGH
LOW

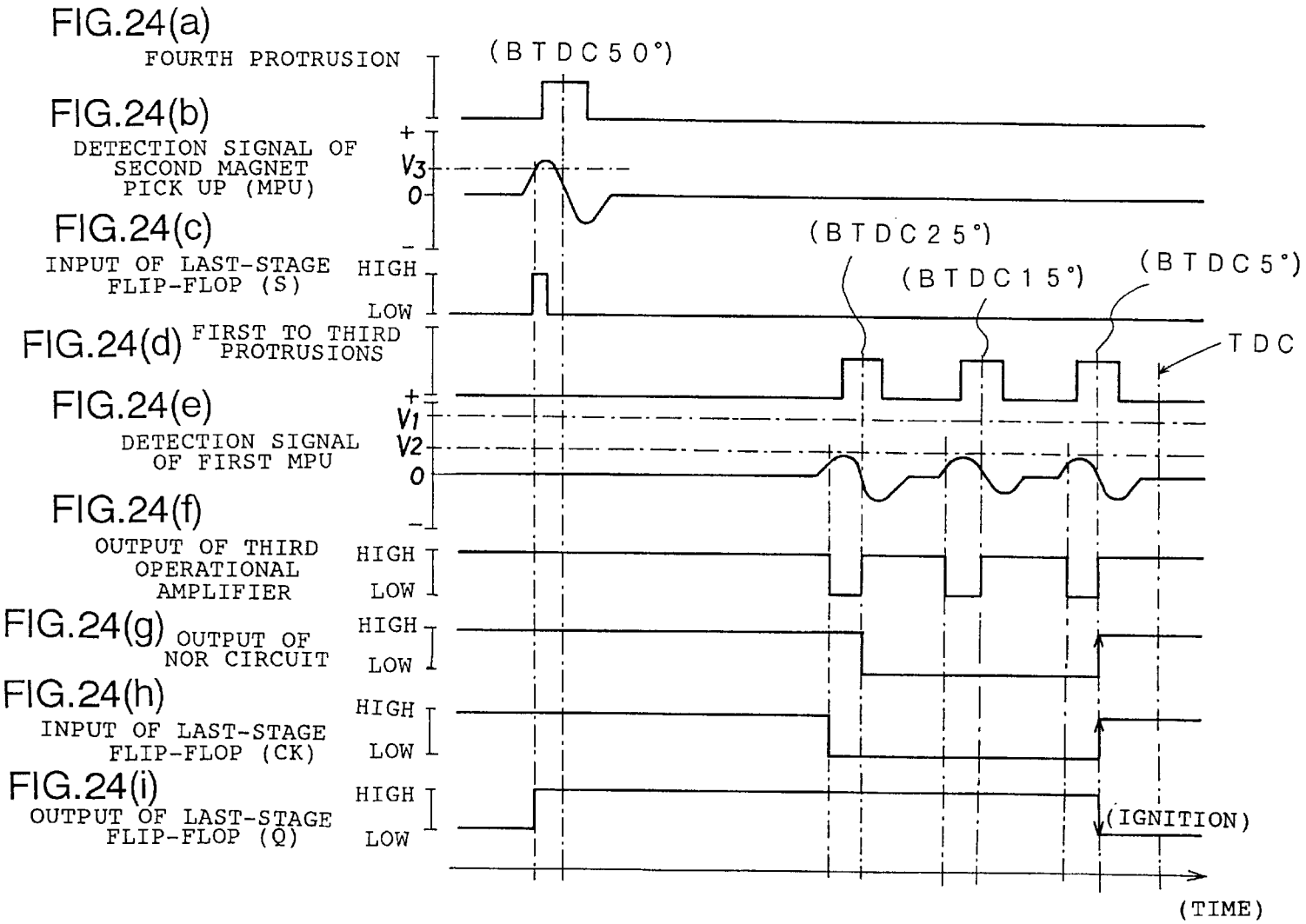
FIG.24(a)
FOURTH PROTRUSION
(BTDC50°)
FIG.24(b)
DETECTION SIGNAL OF SECOND MAGNET PICK UP (MPU)
+
V3
0
FIG.24(c)
INPUT OF LAST-STAGE FLIP-FLOP (S)
-
HIGH
LOW
FIG.24(d)
FIRST TO THIRD PROTRUSIONS
(BTDC25°)
(BTDC15°)
(BTDC5°)
TDC
FIG.24(e)
DETECTION SIGNAL OF FIRST MPU
+
V1
V2
0
-
FIG.24(f)
OUTPUT OF THIRD OPERATIONAL AMPLIFIER
HIGH
LOW
FIG.24(g)
OUTPUT OF NOR CIRCUIT
HIGH
LOW
FIG.24(h)
INPUT OF LAST-STAGE FLIP-FLOP (CK)
HIGH
LOW
FIG.24(i)
OUTPUT OF LAST-STAGE FLIP-FLOP (Q)
HIGH
LOW
(IGNITION)
(TIME)

FIG.25

| | LEVEL OF PEAK VALUE | OUTPUT OF FIRST FLIP-FLOP | OUTPUT OF SECOND FLIP-FLOP | INPUT OF COUNTER (P0) | INPUT OF COUNTER (P1) | USED PROTRUSION |
|---|---|---|---|---|---|---|
| 1 | $Vp < V2$ | 0 | 0 | 0 | 1 | THIRD PROTRUSION |
| 2 | $V2 < Vp < V1$ | 0 | 1 | 1 | 0 | SECOND PROTRUSION |
| 3 | $V1 < Vp$ | 1 | 1 | 0 | 0 | FIRST PROTRUSION |

FIG.27(a)
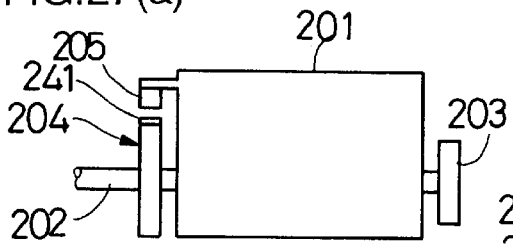
FIG.27(b)
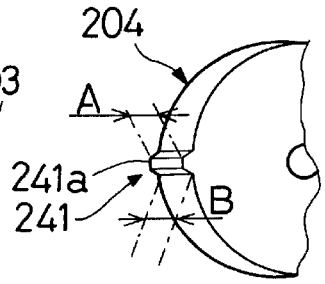
FIG.27(c)
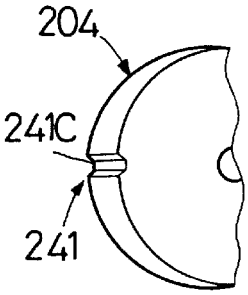
FIG.27(d)
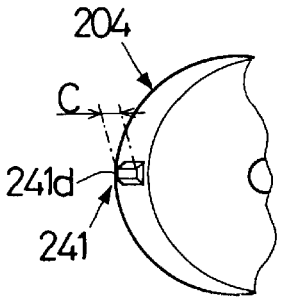
FIG.27(e)
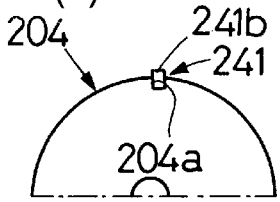
FIG.27(f)
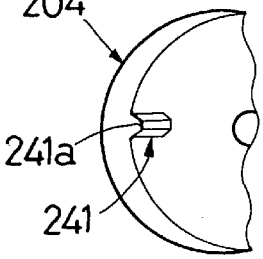
FIG.27(g)
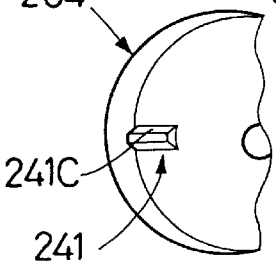
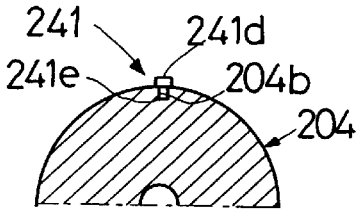
FIG.27(h)
FIG.27(i)
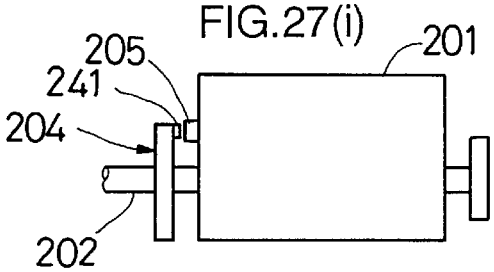

ENGINE IGNITION DEVICE

BACKGROUND OF THE INVENTION

1. Field of the Invention

This invention relates to an ignition device for igniting a fuel-air mixture supplied to an engine. More particularly, it relates to an engine ignition device which is adapted so that an ignition timing may be advanced or delayed in response to a change in an engine speed.

2. Description of the Related Art

A small-sized simple general-purpose engine has been heretofore used as a drive source in a small-sized working machine or the like including a mower, for example. In this type of general-purpose engine, a self-trigger type ignition device having a relatively simple constitution is used in order to ignite a fuel-air mixture supplied to a combustion chamber.

This type of ignition device comprises a spark plug disposed in the combustion chamber of the engine; a flywheel disposed in a crankshaft of the engine; a magnet disposed in the flywheel; and a cored ignition coil adjacent to a revolution locus of the magnet and connected to the spark plug through a high-tension cord.

The magnet is revolved in synchronization with a rotation of the crankshaft. The magnet passes besides the core, whereby a high voltage is generated in the ignition coil. This high voltage is supplied to the spark plug, whereby sparks are generated in the spark plug, so that the fuel-air mixture supplied to the combustion chamber is ignited. In such an ignition device, the timing of the generation of the sparks in the spark plug, i.e., the timing of the ignition of the fuel-air mixture is a constant timing to a rotation cycle of the crankshaft, regardless of a difference in a rotational speed of the crankshaft. Due to this, when the rotational speed of the crankshaft, namely, an engine speed is high, the ignition timing may be too late to obtain a sufficient engine output. When the engine speed is low, the ignition timing may be so early that an idle operation is unstable. Thus, this type of ignition device also requires a function of advancing or delaying the ignition timing in response to the difference in the engine speed.

Japanese Patent Publication No. 61-10672 discloses an example of a trigger type ignition device capable of advancing the ignition timing (hereinafter referred to as "the first prior art"). This ignition device has a control circuit for controlling the ignition timing. The control circuit includes an advance capacitor. The engine speed is increased, whereby a charging potential is increased in the advance capacitor. The timing when a main transistor for actuating the ignition coil is turned on is thus advanced. The timing of the ignition of the spark plug by the ignition coil is consequently advanced.

On the other hand, Japanese Patent Application Laid-open No. 1-262367 discloses another example of the trigger type ignition device capable of advancing the ignition timing (hereinafter referred to as "the second prior art"). In the engine incorporating a flywheel/magnet type generator, this ignition device allows a stator of the generator to be rotatably supported by an electromagnetic force generated between the stator and the magnet on the side of the flywheel rotated in synchronization with the engine. The ignition device has a spring member for suppressing the rotation of the stator in a direction of rotation of the flywheel. The ignition device has a drive mechanism for moving a self-trigger type ignition unit (including a pickup core, etc.) sharing the flywheel. This drive mechanism moves the ignition unit in the opposite direction to the direction of rotation along an outer periphery of the flywheel in response to the rotation of the stator. The ignition unit is moved in response to the difference in the engine speed, whereby the ignition timing of the engine is advanced or delayed.

However, the ignition device according to the first prior art tends to have a relatively narrow advance range of the ignition timing which can be changed by the advance capacitor. Moreover, for a mass-production of the advance capacitor, the set values of time constant associated with the charge of the advance capacitor may be varied and thus the advance values of the ignition timing may be varied.

On the other hand, the ignition device according to the second prior art tends to have a relatively large ignition unit and thus to have a complicated large-sized drive mechanism and support mechanism for moving the ignition unit. Thus, the ignition device is structurally unstable and also has a problem in operation reliability.

SUMMARY OF THE INVENTION

The present invention is made in view of the above-described facts. An object of the present invention is to provide an engine ignition device capable of automatically controlling an ignition timing in a stable manner in response to a difference in an engine speed within a relatively wide variable range by a relatively simple constitution.

To achieve the purpose of the invention, there is provided an engine ignition device for igniting a fuel-air mixture supplied to an engine by emitting sparks to the fuel-air mixture by igniting means, which includes a rotation detector for detecting a rotation of an output shaft of the engine at each predetermined rotational angle and for outputting a detection signal changed in response to a rotational speed of the output shaft; and a timing controller for changing an operating timing of the igniting means in accordance with the detection signal and for operating the igniting means in accordance with the changed operating timing.

According to the above-mentioned constitution, a waveform of the detection signal outputted from the rotation detector is changed in response to the difference in the rotational speed of the output shaft. Thereby, the operating timing of the igniting means is changed in response to the change by the timing controller, so that the timing of the ignition of the fuel-air mixture in the engine is advanced or delayed. Therefore, the timing of the combustion of the fuel-air mixture can be changed in response to the difference in conditions such as a low-speed operation or a high-speed operation of the engine.

For example, in the above-described constitution of the present invention, desirably, the rotation detector includes a protrusion or notch disposed in a flywheel on the output shaft and a magnet pickup, adjacent to a revolution locus of the protrusion or notch, for detecting a passage of the protrusion or notch near the magnet pickup and for outputting, in a pulse manner, a detection signal having a maximum value proportional to its passing speed. The timing controller includes a comparator circuit for comparing the detection signal to a threshold value in order to operate the igniting means when the detection signal outputted from the magnet pickup with the passage of the protrusion or notch is larger than a predetermined threshold value.

According to the above-described constitution, the flywheel is rotated with the rotation of the output shaft, whereby the protrusion or notch passes near the magnet pickup. The pickup outputs, in the pulse manner, the detection signal having the maximum value proportional to the passing speed, i.e., the rotational speed of the output shaft. At this time, the detection signal is compared to the threshold value by the comparator circuit. When the detection signal is larger than the threshold value, the igniting means is operated. When the maximum value of the detection signal is relatively large in proportional to the rotational speed of the output shaft, the detection signal exceeds the threshold value at a relatively early timing to the rotation cycle of the output shaft. On the other hand, when the maximum value of the detection signal is relatively small, the detection signal exceeds the threshold value at a relatively late timing to the rotation cycle of the output shaft.

Accordingly, during the high-speed operation of the engine, the operating timing of the igniting means is relatively advanced. The ignition timing of the fuel-air mixture is advanced. The combustion timing of the fuel-air mixture is adapted to the high-speed operation of the engine. On the other hand, during the low-speed operation of the engine, the operating timing of the igniting means is relatively delayed. The ignition timing of the fuel-air mixture is delayed. The combustion timing of the fuel-air mixture is adapted to the low-speed operation of the engine.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings

FIGS. 22(*a*) to 22(*i*) are time charts showing the relationship among various signals in the fifth embodiment;

FIGS. 23(*a*) to 23(*i*) are time charts showing the relationship among various signals in the fifth embodiment;

FIGS. 24(*a*) to 24(*i*) are time charts showing the relationship among various signals in the fifth embodiment;

FIG. 25 is a table showing the relationship between each level of peak values and various inputs and outputs;

FIGS. 27(*a*) to 27(*i*) are partial views of various types of a detection part; FIG. 27(*a*) shows an engine with a crank position sensor mounted on the surface facing the side of a protrusion or notch disposed on a circumference of the flywheel; FIG. 27(*b*) shows a part of a flywheel with a protrusion integrally provided on the circumference of the flywheel; FIG. 27(*c*) shows one with a notch integrally provided on the circumference; FIG. 27(*d*) shows one with a protrusion having a width smaller than that of FIG. 27(*b*); FIG. 27(*e*) shows one with a protrusion separately provided on the circumference; FIG. 27(*f*) shows one with a leg provided on the circumference; FIG. 27(*g*) shows one with a protrusion integrally provided on a side of the circumference of a flywheel; FIG. 27(*h*) shows one with a notch provided on a side of the circumference of a flywheel; and FIG. 27(*i*) shows an engine with a crank position sensor mounted on the surface facing the side of the protrusion or notch disposed on the side of the flywheel.

DETAILED DESCRIPTION OF THE PREFERRED EMBODIMENTS

A first embodiment of an engine ignition device of the present invention will be described in detail below with reference to FIGS. 1 through 8.

Figure 1:
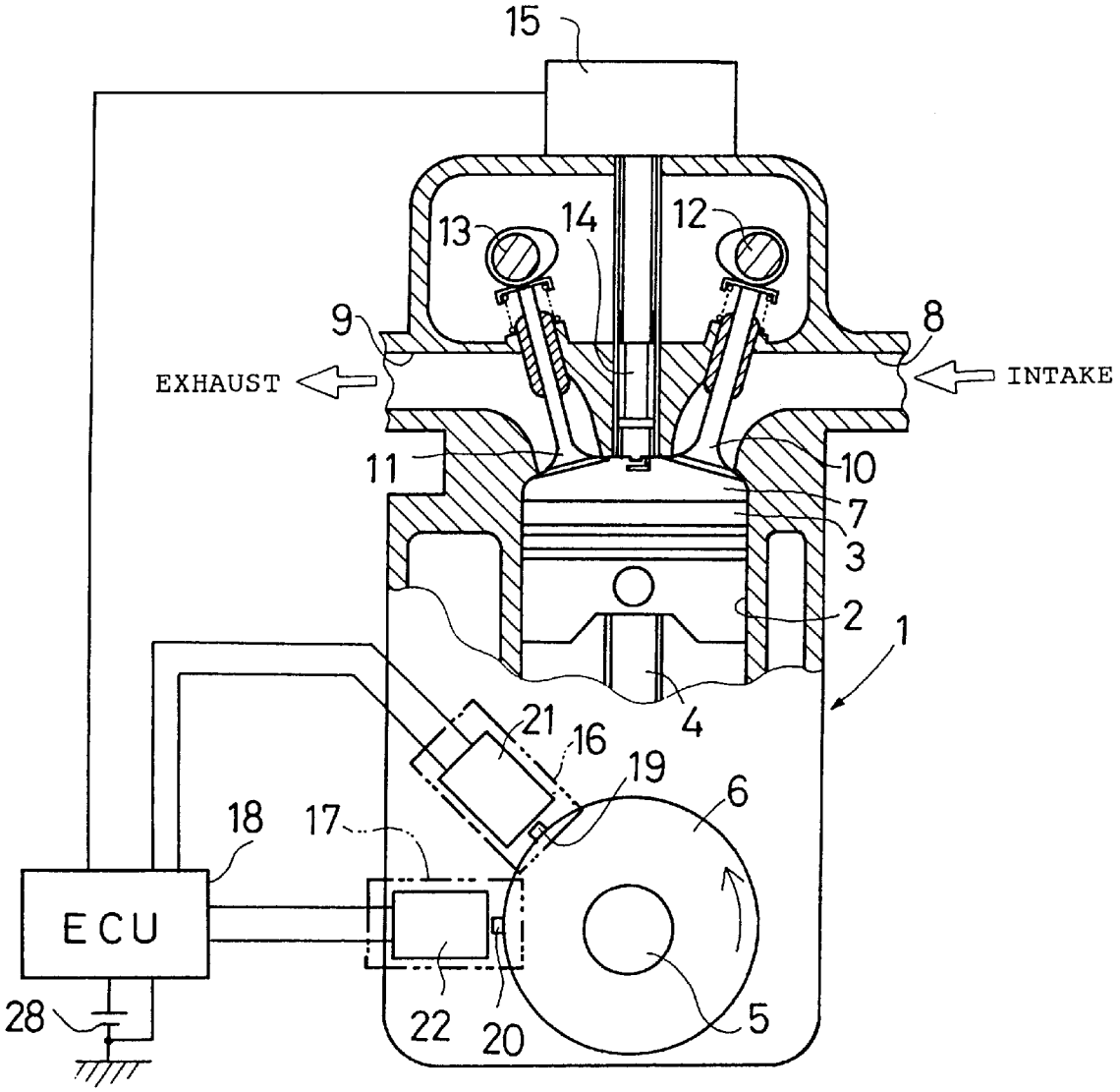
FIG. 1 is a schematic view showing an engine and an ignition device for the engine in a first embodiment according to the present invention.

FIG. 1 is a schematic illustration showing a spark ignition type engine 1 and the ignition device for the engine 1 of this embodiment. This engine 1 is a simple small-sized general-purpose type applied to a small-sized working machine or the like including a mower. That is, the engine 1 is a single cylinder type. The engine 1 includes one piston 3 which is disposed in one cylinder bore 2 so that it may be vertically movable; a crankshaft 5 as an output shaft connected to the piston 3 through a connecting rod 4; a flywheel 6 fixed on the crankshaft 5; a combustion chamber 7 disposed above the piston 3 in the cylinder bore 2.

The engine 1 includes an intake path 8 and an exhaust path 9 communicated with the combustion chamber 7; an intake valve 10 and an exhaust valve 11 for opening/closing the paths 8 and 9, respectively; cam shafts 12 and 13 for driving the valves 10 and 11, respectively; and a spark plug 14 disposed in the combustion chamber 7. The cam shafts 12 and 13 are driven in synchronization with the rotation of the crankshaft 5. The valves 10 and 11 are therefore opened/closed in synchronization with the vertical movement of the piston 3 and the rotation of the crankshaft 5, i.e., in synchronization with an intake step, a compression step, a combustion step and an exhaust step of the engine 1. The crankshaft 5 is rotated twice for each one series of the above-mentioned steps, that is, for each one cycle of the engine 1.

In the intake step, the intake valve 10 is opened, whereby a fuel-air mixture of a fuel supplied by a fuel supply device (not shown) such as a carburetor and an outside air is introduced into the combustion chamber 7 through the intake path 8. In the compression step, the piston 3 is then moved upward so that the fuel-air mixture is compressed. Sparks are emitted to the fuel-air mixture by the spark plug 14, whereby the fuel-air mixture is ignited. The operation proceeds to the combustion step. In this combustion step, the piston 3 is pushed down, whereby the crankshaft 5 is rotated so that a driving force is applied to the engine 1. Then, in the exhaust step, the piston 3 is moved upward again so that the exhaust valve 11 is opened, whereby a combusted exhaust gas is discharged from the combustion chamber 7 through the exhaust path 9 to the outside.

In this embodiment, the ignition device comprises the above-mentioned spark plug 14; an ignition coil 15; first and second rotation sensors 16 and 17 constituting a rotation detector; and an electronic control unit (ECU) 18 constituting timing controller.

Figure 6:
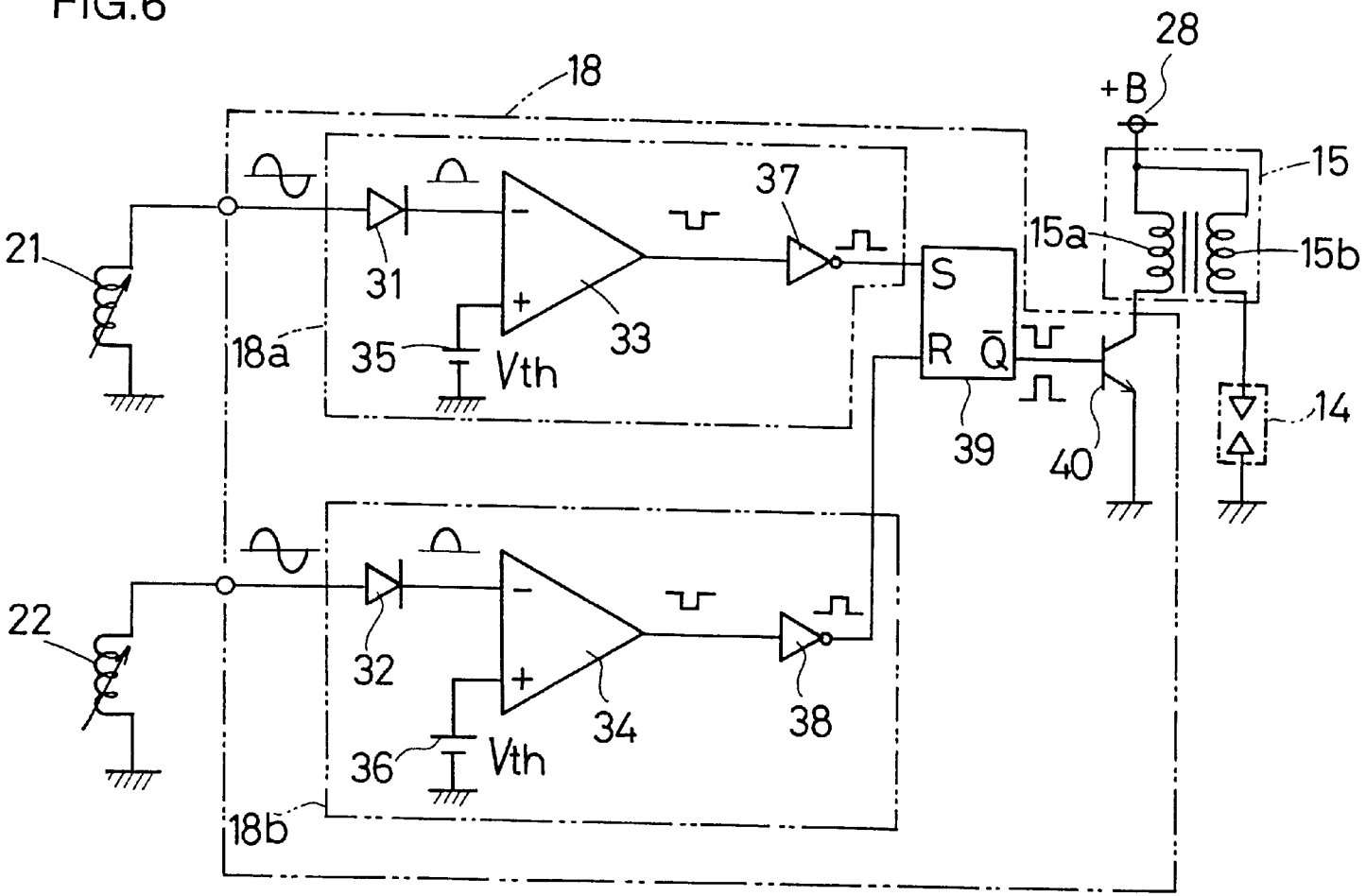
FIG. 6 is an electrical circuit diagram showing an electrical circuit constitution of the ignition device in the first embodiment.

The ignition coil 15 is used for supplying a high voltage to the spark plug 14 in order to drive the spark plug 14. As shown in FIG. 6, the ignition coil 15 includes a primary coil 15*a* and a secondary coil 15*b*. This ignition coil 15 is used for supplying the high voltage induced by the secondary coil 15*b* to the spark plug 14 when a current supplied to the primary coil 15*a* is interrupted. The spark plug 14 and the ignition coil 15 constitute igniting means.

The rotation sensors 16 and 17 detect the rotation of the crankshaft 5 at each predetermined rotational angle ("360 degrees" in this embodiment). The sensors 16 and 17 output, in a pulse manner, a detection signal having a maximum value (peak value) in response to the rotational speed of the crankshaft 5, i.e., the rotational speed of the engine 1. The rotation sensors 16 and 17 include first and second protrusions 19 and 20 disposed on an outer periphery of the flywheel 6; and first and second magnet pickups 21 and 22 corresponding to the protrusions 19 and 20, respectively. The magnet pickups 21 and 22 are adjacent to a revolution locus of the protrusions 19 and 20. When the protrusions 19 and 20 pass near the magnet pickups 21 and 22, the magnet pickups 21 and 22 output, in the pulse manner, the detection signal having the peak value proportional to their passing speed. The first magnet pickup 21 is used for determining the timing of the interruption of the current applied to the primary coil 15*a* of the ignition coil 15 in order to supply the high voltage to the spark plug 14. The second magnet pickup 22 is used for determining the timing of the start of the application of the current to the primary coil 15*a* prior to the interruption of the current applied to the primary coil 15*a*.

Figure 2:
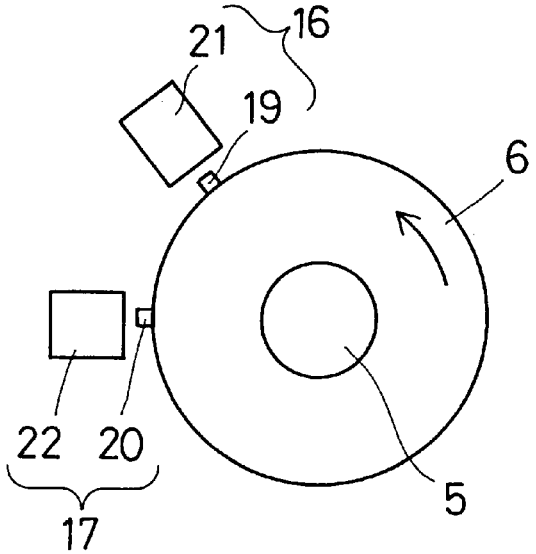
FIG. 2 is a conceptual view showing arrangement of magnet pickups with respect to a flywheel in the first embodiment.
Figure 3:
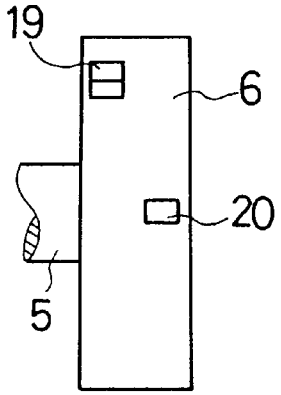
FIG. 3 is a conceptual view showing arrangement of protrusions on the flywheel in the first embodiment.
Figure 4:
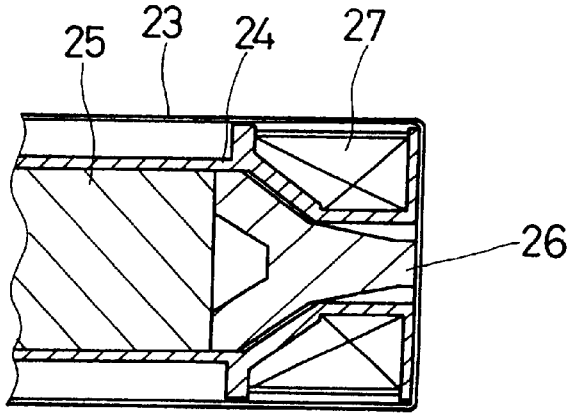
FIG. 4 is a cross sectional partial view of an internal structure of the magnet pickups in the first embodiment.

FIG. 2 shows the arrangement of the magnet pickups 21 and 22 with respect to the flywheel 6. Both of the magnet pickups 21 and 22 are arranged so that they may have a predetermined angular distance therebetween. In FIGS. 1 and 2, for convenience, the angular distance between the two protrusions 19 and 20 is equal to the angular distance between the two magnet pickups 21 and 22. However, they are not actually equal. FIG. 3 shows the arrangement of the protrusions 19 and 20 on the flywheel 6. Both of the protrusions 19 and 20 are arranged so that they may be offset along an axial direction of the crankshaft 5. FIG. 4 shows an internal structure of the magnet pickups 21 and 22. Each of the magnet pickups 21 and 22 comprises a bobbin 24 contained in a case 23; a magnet 25 and a core 26 arranged within the bobbin 24; and a coil 27 which is wound around the bobbin 24 so that it may correspond to the core 26.

Figure 5:
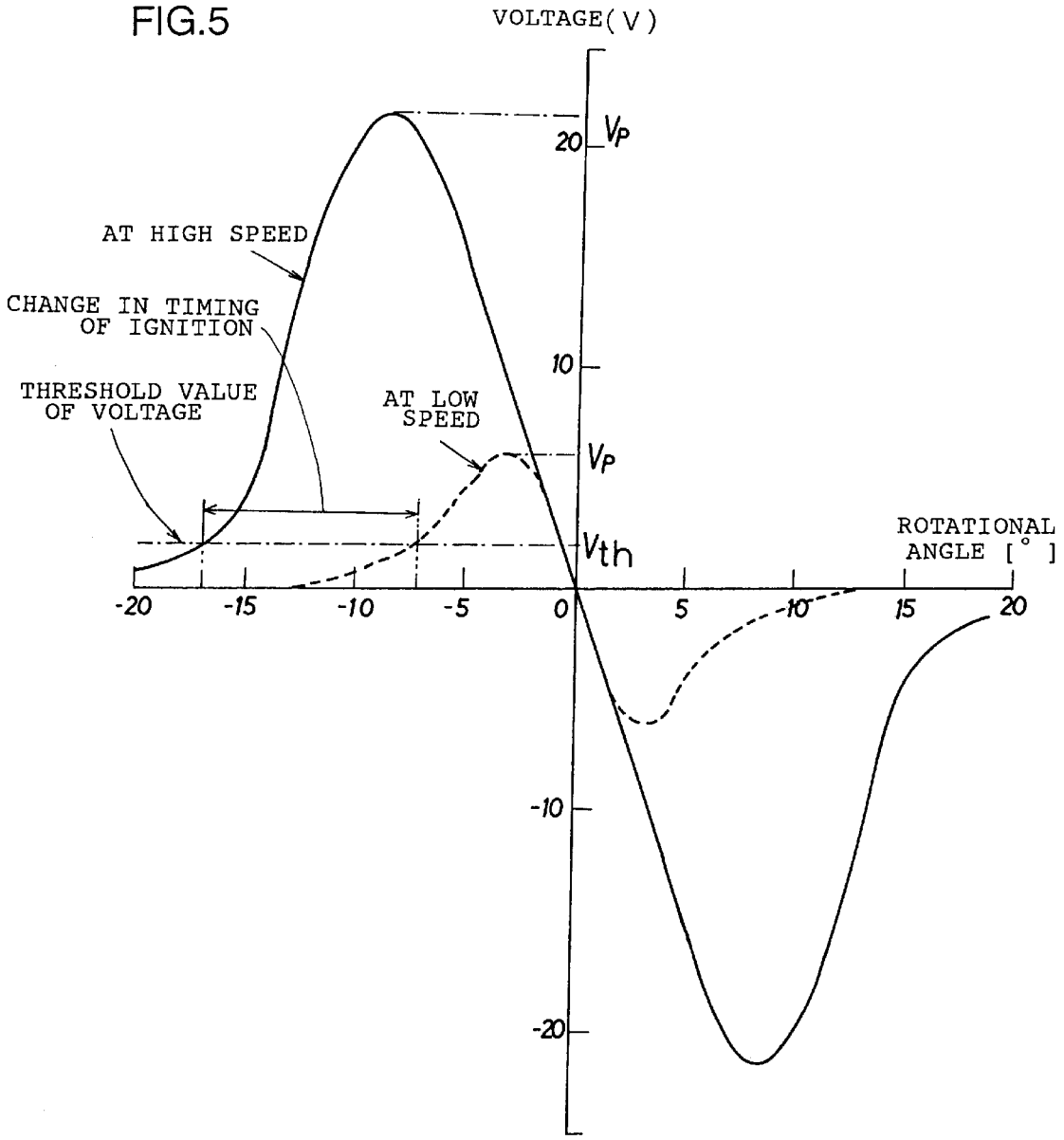
FIG. 5 is a graph showing a waveform of a detection signal outputted from the magnet pickups in the first embodiment.

FIG. 5 shows a waveform of the detection signal associated with a change in the voltage which is outputted when the magnet pickups 21 and 22 detect the corresponding protrusions 19 and 20, respectively. This detection signal has a substantially sinusoidal waveform. The higher a revolving speed of the protrusions 19 and 20, i.e., the rotational speed of the crankshaft 5 is, the higher a peak value Vp is. The voltage has a small width of time near the peak value. On the other hand, the lower the rotational speed of the crankshaft 5 is, the lower the peak value Vp is. The voltage has a great width of time near the peak value.

The magnet pickups 21 and 22 are connected to the ECU 18. A battery 28 is connected to the ECU 18. FIG. 6 shows an electrical constitution of the ignition device including the ECU 18. The ECU 18 includes a first comparator circuit 18*a*, a second comparator circuit 18*b*, one flip-flop 39, and one transistor 40. The first comparator circuit 18*a* comprises a first diode 31, a first operational amplifier 33, a first battery 35, and a first inverter 37. The second comparator circuit 18*b* includes a second diode 32, a second operational amplifier 34, a second battery 36, and a second inverter 38.

The first magnet pickup 21 is connected to a negative input terminal of the first operational amplifier 33 through the first diode 31. The first battery 35 is connected to a positive input terminal of the first operational amplifier 33. This battery 35 is used for determining a threshold value Vth to be compared to the detection signal of the first magnet pickup 21. An output terminal of this operational amplifier 33 is connected to a set input terminal of the flip-flop 39 through the first inverter 37. On the other hand, the second magnet pickup 22 is connected to the negative input terminal of the second operational amplifier 34 through the second diode 32. The second battery 36 is connected to the positive input terminal of the second operational amplifier 34. This battery 36 is used for determining the threshold value Vth to be compared to the detection signal of the second magnet pickup 22. The output terminal of this operational amplifier 34 is connected to a reset input terminal of the flip-flop 39 through the second inverter 38. In this embodiment, the second magnet pickup 22, the second comparator circuit 18*b*, the flip-flop 39 and the transistor 40 constitute a current applying device for starting the application of the current to the primary coil 15*a* before interrupting the current applied to the primary coil 15*a*. In this constitution, the second comparator circuit 18*b*, the flip-flop 39 and the transistor 40 constitute a current applying circuit. On the other hand, the first magnet pickup 21, the first comparator circuit 18*a*, the flip-flop 39 and the transistor 40 constitute an interrupting device for interrupting the current applied to the primary coil 15*a*. In this constitution, the first comparator circuit 18*a*, the flip-flop 39 and the transistor 40 constitute an interrupting circuit. An inverse output terminal of the flip-flop 39 is connected to a base of the transistor 40. A collector of the transistor 40 is connected to the primary coil 15*a* of the ignition coil 15. The ignition coil 15 is connected to the battery 28. The secondary coil 15*b* of the ignition coil 15 is connected to the spark plug 14.

Next, the operation of the engine ignition device constituted as described above will be described.

During the operation of the engine 1, the crankshaft 5 is rotated so that the flywheel 6 is rotated counterclockwise (in the direction indicated by an arrow) in FIGS. 1 and 2, whereby the first and second protrusions 19 and 20 are revolved. When the second protrusion 20 passes near the second magnet pickup 22, the magnet pickup 22 outputs the detection signal of the substantially sinusoidal waveform having the peak value Vp in response to the passing speed of the protrusion 20, i.e., the rotational speed of the crankshaft 5. The second diode 32 rectifies this detection signal. The second operational amplifier 34 compares the rectified signal to a predetermined threshold value Vth. When the rectified signal exceeds the threshold value Vth, the second operational amplifier 34 outputs a low-level signal. The second inverter 38 inverts the output signal to a high-level signal and outputs the high-level signal. When this high-level signal is inputted to the reset input terminal of the flip-flop 39, the flip-flop 39 outputs the high-level signal from the inverse output terminal to the transistor 40. When the transistor 40 receives this signal and is turned on, the current is applied to the primary coil 15*a* of the ignition coil 15.

Next, the second protrusion 20 passes near the second magnet pickup 22, and then slightly late the first protrusion 19 passes near the first magnet pickup 21. At this time, the magnet pickup 21 outputs the detection signal of the substantially sinusoidal waveform having the peak value Vp in response to the rotational speed of the crankshaft 5. The first diode 31 rectifies this detection signal. The first operational amplifier 33 compares the rectified signal to a predetermined threshold value Vth. When the rectified signal exceeds the threshold value Vth, the first operational amplifier 33 outputs the low-level signal. The first inverter 37 inverts the output signal to the high-level signal and outputs the high-level signal. When this high-level signal is inputted to the set input terminal of the flip-flop 39, the flip-flop 39 outputs the low-level signal from the inverse output terminal to the transistor 40. When the transistor 40 receives this signal and is turned off, the current applied to the primary coil 15*a* is interrupted. At this time, the high voltage is induced by the secondary coil 15*b*. When the high voltage is supplied to the spark plug 14, the sparks are emitted by the spark plug 14. When these sparks are emitted in the compression step of the engine 1, the fuel-air mixture introduced in the combustion chamber 7 is ignited. The fuel-air mixture is then exploded and combusted. Thereby, the piston 3 is pushed down so that a torque is applied to the crankshaft 5. The crankshaft 5 is thus rotated so that the driving force is applied to the engine 1. Although these sparks are also emitted in the exhaust step of the engine 1, the sparks are ineffective sparks at that time.

Figures 7A, 7B, 7C, 7D, 7E, 7F, 7G, 7H:
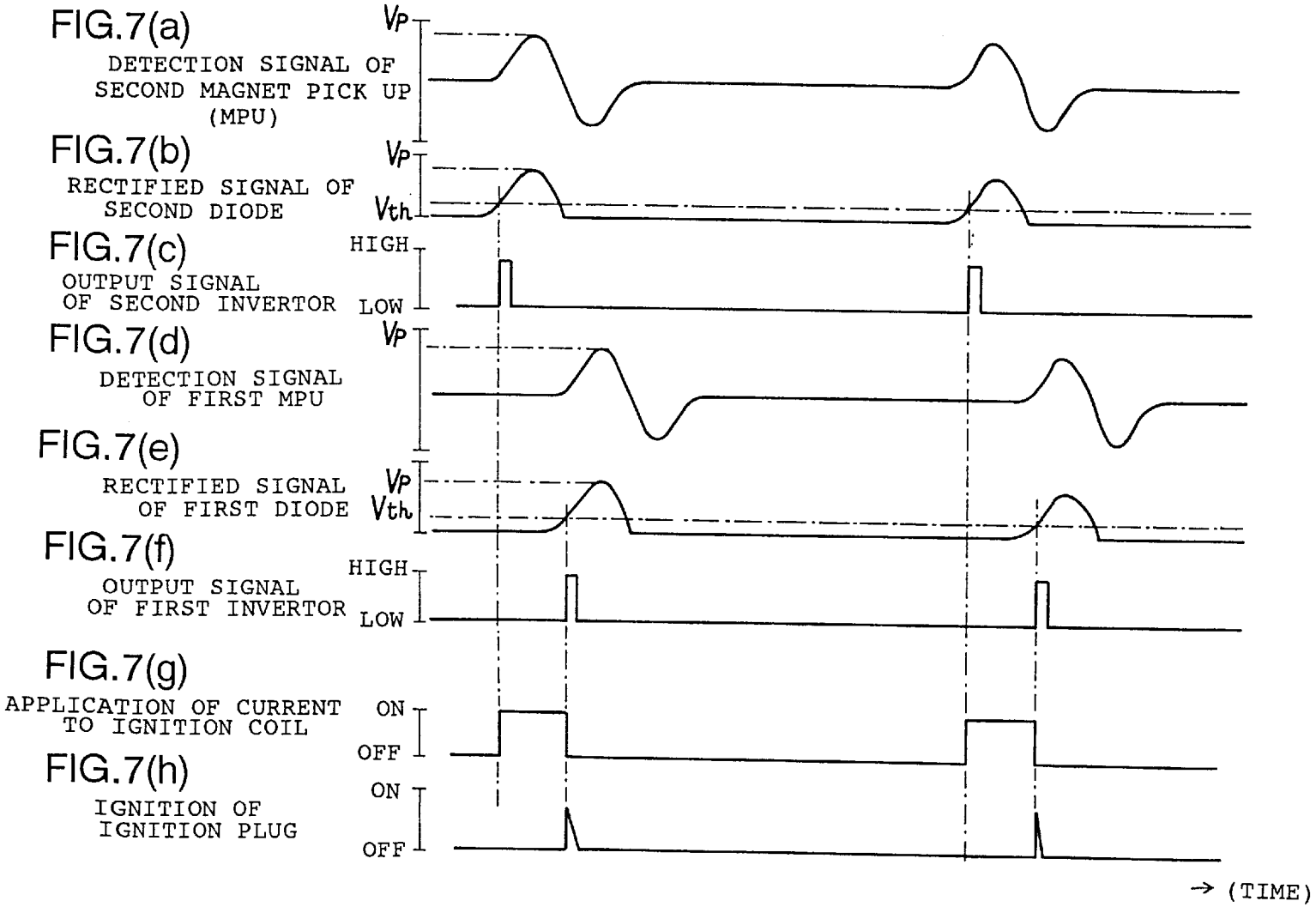
FIGS. 7(*a*) to 7(*h*) are time charts showing the relationship among various signals.

A relationship among the above-described signals is conceptually shown in time charts of FIGS. 7(*a*)–7(*h*). As can be seen from this time chart, the timing when the rectified signal associated with the detection signal of the first magnet pickup 21 exceeds the threshold value Vth corresponds to the timing of the generation of the sparks in the spark plug 14, i.e., the timing of the ignition of the fuel-air mixture.

On the other hand, as can be seen from a graph shown in FIG. 5, there is a difference in the timing when the detection signal exceeds the threshold value Vth between the high-speed operation and the low-speed operation of the rotational speed of the crankshaft 5. The latter timing is later than the former timing. In other words, the timing of the ignition is more advanced during the high-speed operation than during the low-speed operation.

Figure 8:
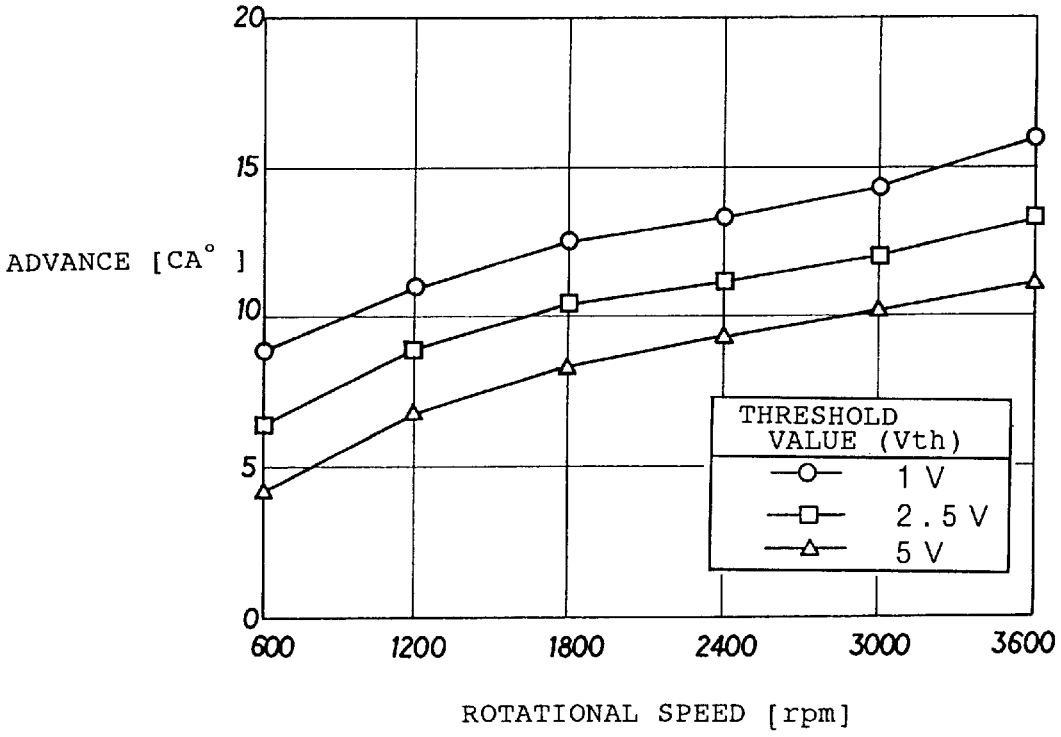
FIG. 8 shows the relationship between a rotational speed and a degree of advance of an ignition timing.

FIG. 8 shows the relationship between the changed rotational speed of the crankshaft 5 and the degree of advance of the ignition timing. In this graph, different curves represent the difference in the degree of advance among the changed threshold values Vth. As can be seen from this graph, the higher the rotational speed is, the more the degree of advance is proportionally increased. On the other hand, as the threshold value Vth becomes higher, the degree of advance is relatively reduced.

As described above, the peak value Vp of the detection signal outputted from the first magnet pickup 21 is changed in response to the difference in the rotational speed of the crankshaft 5, i.e., the rotational speed of the engine 1. Thereby, the timing of the generation of the sparks in the spark plug 14 is controlled in response to the difference in the peak value Vp. As a result, the timing of the ignition of the fuel-air mixture in the combustion chamber 7 is advanced or delayed. The combustion timing of the fuel-air mixture can be therefore changed in response to the difference in operation conditions such as the low-speed operation or the high-speed operation of the engine 1.

More specifically, when the flywheel 6 is rotated with the crankshaft 5, the protrusions 19 and 20 pass near the magnet pickups 21 and 22. The magnet pickups 21 and 22 then output, in the pulse manner, the detection signal having the peak value Vp proportional to the passing speed, namely, the rotational speed of the engine 1. At this time, the detection signal is compared to the threshold value Vth by the operational amplifiers 33 and 34. When the detection signal is larger than the threshold value Vth, the ECU 18 operates the spark plug 14. When the peak value Vp of the detection signal of the magnet pickups 21 and 22 is relatively large in proportional to the rotational speed of the engine 1, the detection signal exceeds the threshold value Vth at a relatively early timing to the rotation cycle of the crankshaft 5. On the other hand, when the peak value Vp of the detection signal of the magnet pickups 21 and 22 is relatively small, the detection signal exceeds the threshold value vth at a relatively late timing to the rotation cycle of the crankshaft 5.

Accordingly, during the high-speed operation of the engine 1, the timing of the generation of the sparks by the spark plug 14 is relatively advanced. The timing of the ignition of the fuel-air mixture in the combustion chamber 7 is advanced. The combustion timing of the fuel-air mixture is thus adapted to the high-speed operation of the engine 1. On the other hand, during the low-speed operation of the engine 1, the timing of the generation of the sparks by the spark plug 14 is relatively delayed. The timing of the ignition of the fuel-air mixture in the combustion chamber 7 is delayed. The combustion timing of the fuel-air mixture is thus adapted to the low-speed operation of the engine 1.

According to the ignition device of this embodiment, unlike the ignition device of the above-described second prior art having a complicated large-sized drive mechanism and support mechanism, the ignition timing can be automatically controlled in a stable manner in response to the difference in the rotational speed of the engine 1 by a relatively simple constitution including the flywheel 6 having a pair of protrusions 19 and 20, a pair of magnet pickups 21 and 22 and the ECU 18. In addition, according to the ignition device of this embodiment, unlike the ignition device of the above-described first prior art having a relatively narrow advance range of the ignition timing, the ignition timing can be automatically controlled in the stable manner in response to the difference in the rotational speed of the engine 1 within the range of the change in the rotational speed of the engine 1, a relatively wide variable range.

The ignition device of this embodiment requires the two magnet pickups 21 and 22 for the application of the current to the ignition coil 15 and the interruption of the current applied thereto. However, a circuit constitution of the ECU 18 can be relatively simple.

Next, an engine and an ignition device for the engine in a second embodiment according to the present invention will be described hereinafter, referring to FIGS. 9 and 10.

It is noted that, in the second and following embodiments, like elements corresponding to those in the first embodiment are indicated by like numerals and the detailed explanation thereof is omitted. Therefore, the different points from the first embodiment are mainly explained in the following embodiments.

Figure 9:
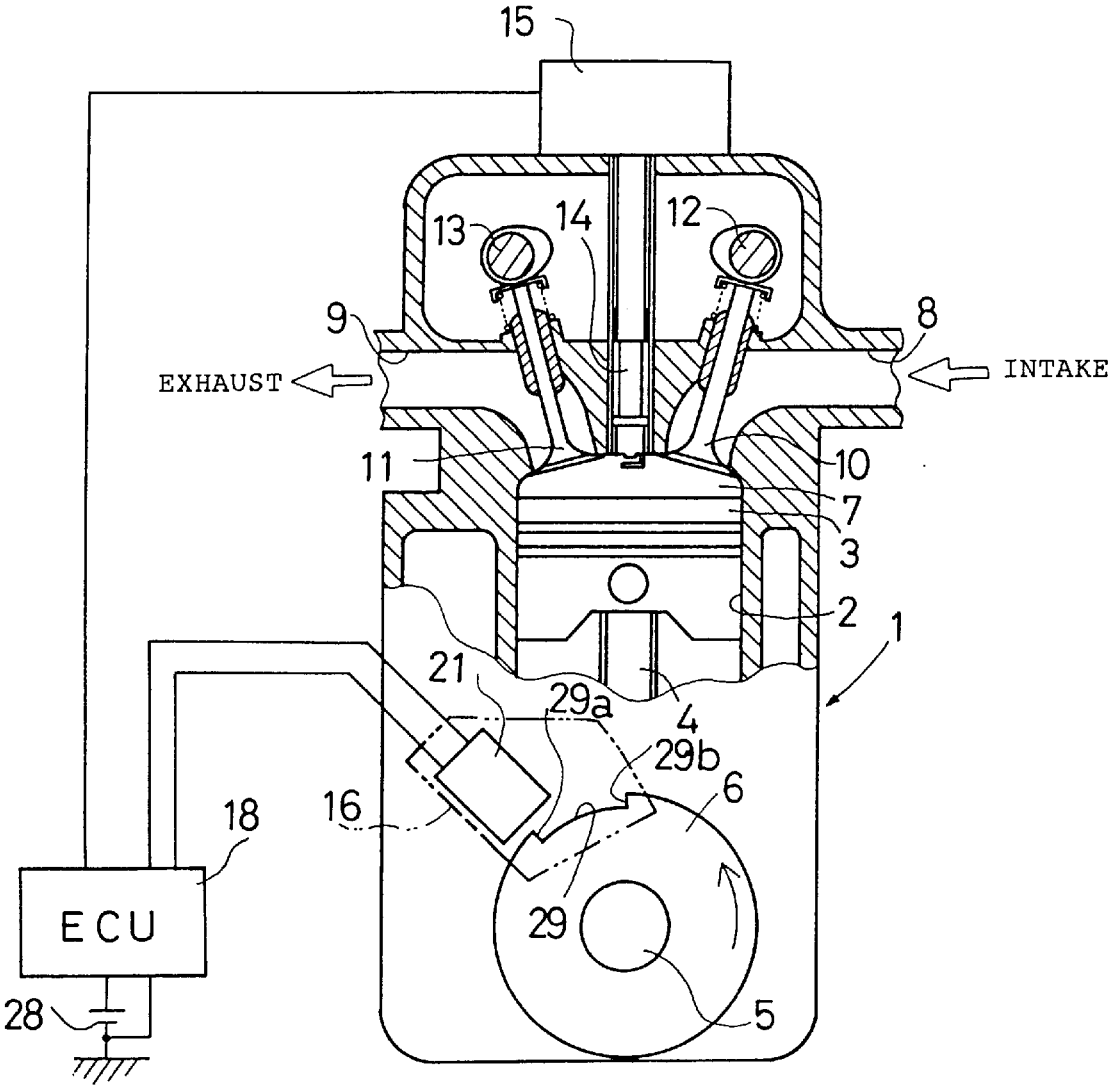
FIG. 9 is a schematic view showing an engine and an ignition device for the engine in a second embodiment according to the present invention.

FIG. 9 shows a schematic construction of an engine 1 and an ignition device for the engine in the second embodiment. In this embodiment, instead of the pair of protrusions 19 and 20 and the second magnet pickups 22 in the first embodiment, a notch 29 is provided having a predetermined angular width on the circumference of a flywheel 6. Those magnet pickup 21 and the notch 29 constitute the first rotation sensor 16 serving as a rotation detector. The notch 29 comprises a first and second drop edges 29*a* and 29*b* which are disposed on a front side and a rear side respectively in the rotational direction of the flywheel 6. The construction of a circuit of the ECU 18 is designed to adapt to the structure of the rotation sensor 16.

Figure 10:
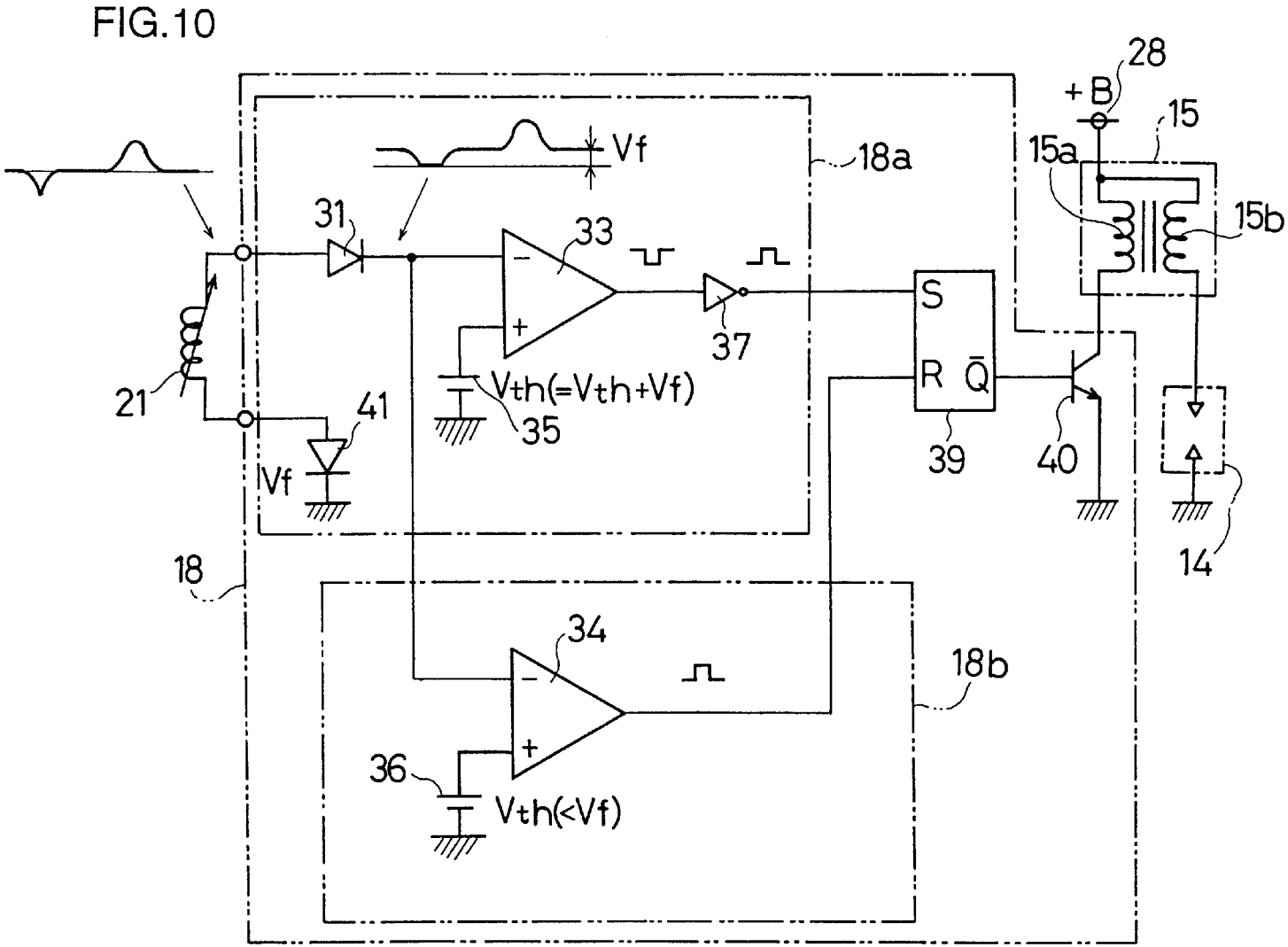
FIG. 10 is an electrical circuit diagram showing an electrical circuit constitution of the ignition device in the second embodiment.

FIG. 10 shows an electrical constitution of the ignition device including the ECU 18. The first comparator circuit 18*a* in this embodiment, differing from that in the first embodiment, further comprises a third diode 41 connected to the earthed side of the first magnet pickup 21. This diode 41 is used for raising the rectified signal outputted from the first diode by a reference value Vf. Here, the first magnet pickup 21, the first comparator circuit 18*a*, the flip-flop 39 and the transistor 40 constitute an interrupting device for interrupting the current applied to the ignition coil 15. In this constitution, the first comparator circuit 18*a*, the flip-flop 39 and the transistor 40 constitute an interrupting circuit included in the ECU 18. In the second comparator circuit 18*b*, on the other hand, the second diode 32 in the first embodiment is omitted. Instead thereof, the negative input terminal of the second operational amplifier 34 is connected to the output side of the first diode 31. In this embodiment, the magnet pickup 21, the second comparator circuit 18*b*, the flip-flop 39 and the transistor 40 constitute a current applying for starting the application of the current to the ignition coil 15. In this constitution, the second comparator circuit 18*b*, the flip-flop 39 and the transistor 40 constitute a current applying circuit included in the ECU 18. In the above construction, the threshold value vth determined by the first battery 35 equals to a magnitude of the threshold value Vth adding in the reference value Vf. The threshold value Vth determined by the second battery 36 is less than the reference value Vf. In view of the above points, the ignition device in the present embodiment differs in construction from that in the first embodiment.

Next, the operation of the engine ignition device constituted as described above will be described.

As shown in FIG. 9, the flywheel 6 is rotated counterclockwise (in the direction indicated by an arrow) along with the crankshaft 5, whereby the notch 29 is revolved. When the first drop edge 29*a* passes near the magnet pickup 21, the magnet pickup 21 outputs the detection signal of a reverse waveform having the peak value Vp in response to the passing speed of the drop edge 29*a*, i.e., the rotational speed of the engine 1. The first diode 31 rectifies this detection signal and outputs it to the first and second operational amplifiers 33 and 34. Both the operational amplifiers 33 and 34 compare the rectified signal to a predetermined threshold value Vth. This rectified signal is based on the negative peak value Vth, whereby the first operational amplifier 33 does not operate. When the rectified signal falls below the threshold value Vth in the second operation amplifier 34, the amplifier 34 outputs a high-level signal. When this high-level signal is inputted to the reset input terminal of the flip-flop 39, the flip-flop 39 outputs the high-level signal from the inverse output terminal to the transistor 40. When the transistor 40 receives this signal and is turned on, the current is applied to the primary coil 15*a* of the ignition coil 15.

Next, the second drop edge 29*b* slightly late passes near the magnet pickup 21. At this time, the magnet pickup 21 outputs the detection signal of the waveform having the peak value Vp in response to the rotational speed of the engine 1. The first diode 31 rectifies this detection signal and outputs it to the first and second operational amplifiers 33 and 34. Both the operational amplifiers 33 and 34 compares the rectified signal to a predetermined threshold value Vth. This rectified signal is based on the positive peak value Vp. When the rectified signal exceeds the threshold value Vth, the first operational amplifier 33 outputs a low-level signal. The first inverter 37 inverts the output signal to the high-level signal and outputs the high-level signal. When this high-level signal is inputted to the set input terminal of the flip-flop 39, the flip-flop 39 outputs the low-level signal from the inverse output terminal to the transistor 40. When the transistor 40 receives this signal and is turned off, the current applied to the primary coil 15*a* is interrupted. At this time, the high voltage is induced by the secondary coil 15*b*. When the high voltage is supplied to the spark plug 14, the sparks are emitted by the spark plug 14. When these sparks are emitted in the compression step of the engine 1, the fuel-air mixture introduced in the combustion chamber 7 is ignited. The fuel-air mixture is then exploded and combusted. Thereby, the piston 3 is pushed down so that a torque is applied to the engine 1.

Accordingly, the ignition device in this embodiment can basically provide the operation and effect substantially equal to that in the first embodiment. In addition, in the ignition device in this embodiment, applying current to the ignition coil 15 and interrupting the current applied to the ignition coil 15 can be made by one magnet pickup 21 alone. In this sense, compared with the ignition device in the first embodiment requiring the two magnet pickups 21 and 22, the mechanical construction of the ignition device in this embodiment can be more simplified.

Next, an ignition device for an engine in a third embodiment according to the present invention will be described hereinafter with reference to FIGS. 11 to 13.

Figure 11:
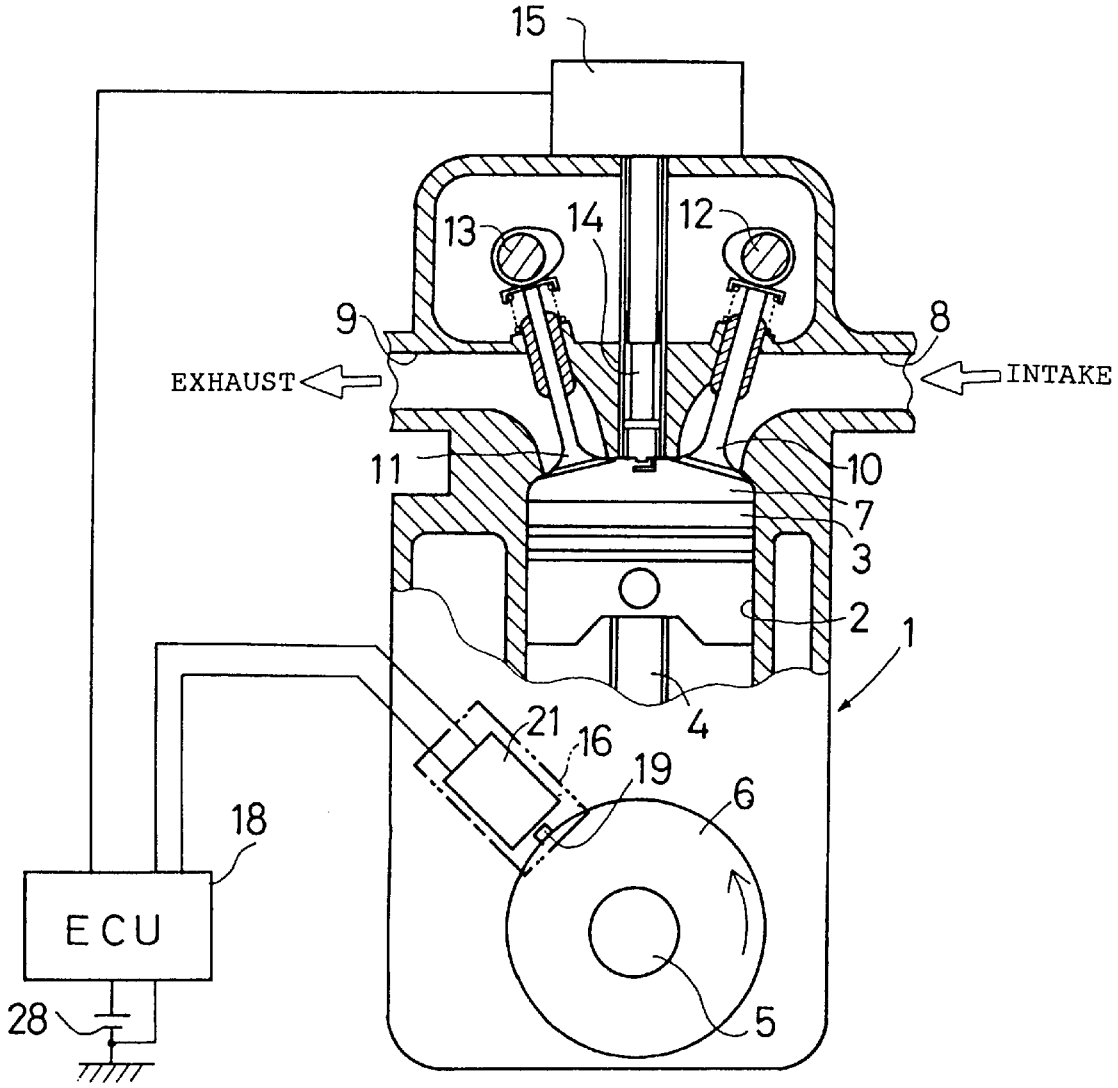
FIG. 11 is a schematic view showing an engine and an ignition device for the engine in a third embodiment according to the present invention.

FIG. 11 shows the engine 1 and the ignition device for the engine 1 in this embodiment. In this embodiment, instead of the notch 20 provided on the flywheel in the second embodiment, a single protrusion 19 is provided on a circumference of the flywheel 6. The magnet pickup 21 and the protrusion 19 constitute the rotation sensor 16 serving as a rotation detector. The construction of a circuit of the ECU 18 is designed to adapt to the structure of the rotation sensor 16.

Figure 12:
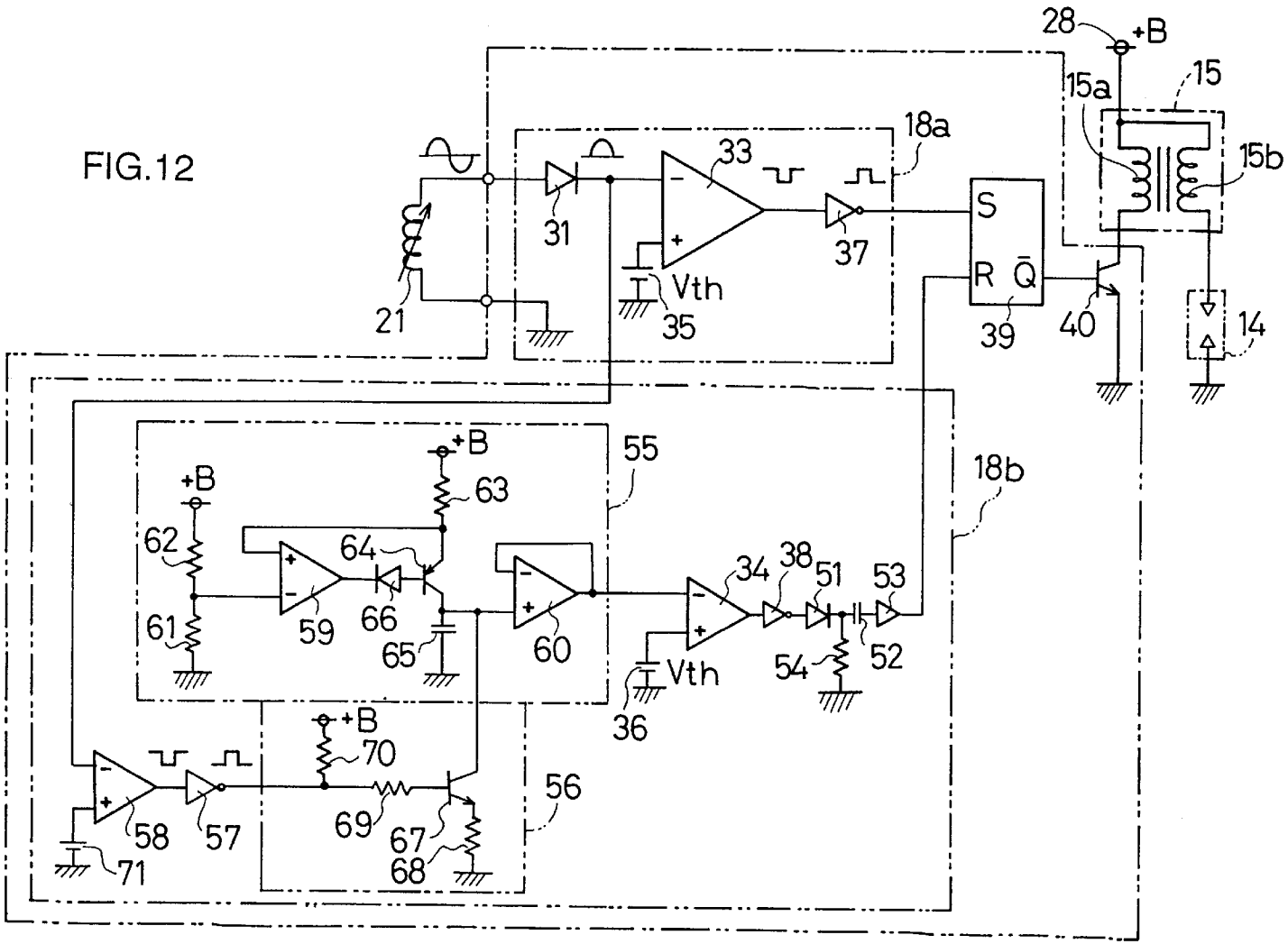
FIG. 12 is an electrical circuit diagram showing an electrical circuit constitution of the ignition device in the third embodiment.
Figures 13A, 13B, 13C, 13D:
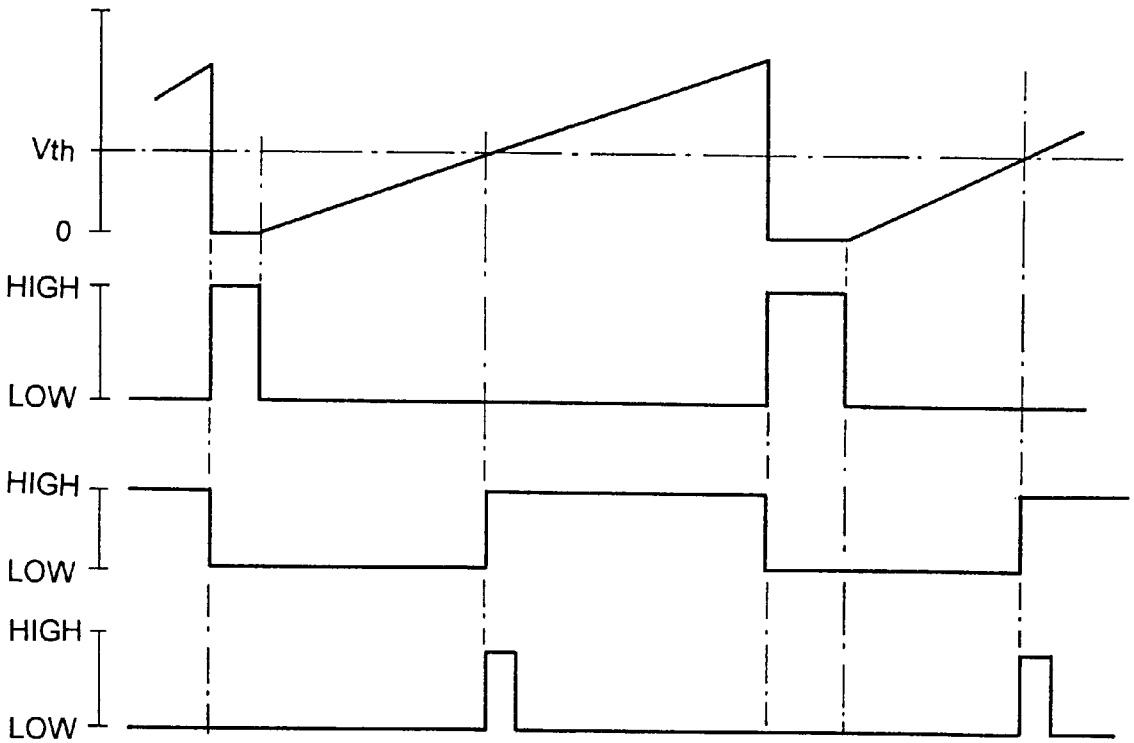
FIGS. 13(*a*) to 13(*d*) are time charts showing the relationship among various signals.

FIG. 12 shows an electrical constitution of the ignition device including the ECU 18. The third diode 41 provided in the second embodiment is omitted from the first comparator circuit 18*a* in this embodiment. Furthermore, in this embodiment, the construction of the second comparator circuit 18*b* is made different from that in the second embodiment.

That is, the second comparator circuit 18*b* comprises the second operational amplifier 34, and the second battery 36 and the second inverter 38 connected to the amplifier 34. In addition thereto, this comparator circuit 18*b* is provided with a diode 51 connected in series to the output terminal of the second inverter 38, a condenser 52 and an amplifier 53, and a resistance 54 connected between the diode 51 and the condenser 52. In this structure, the output terminal of the amplifier 53 is connected to the reset input terminal of the flip-flop 39. This comparator circuit 18*b* is further provided with a constant current integrator circuit 55 connected to the negative input terminal of the second operational amplifier, a reset circuit 56, and an inverter 57 and an operational amplifier 58.

The constant current integrator circuit 55 comprises two operational amplifiers 59 and 60, resistances 61 and 62 connected in series, a resistance 63, a transistor 64, and a condenser 65, connected in series, and a diode 66 connected to the base of the transistor 64. One of the two resistance 61 and 62 is earthed, while another one is connected to the battery 28. The negative input terminal of the operational amplifier 59 is connected between the two resistance 61 and 62. The diode 66 is connected in a reverse direction to the output terminal of this operational amplifier 59. The positive input terminal of the operational amplifier 59 is connected between the resistance 63 and the transistor 64. An end of the resistance 63 is connected to the battery 28. The positive input terminal of the other operational amplifier 60 is connected between a collector of the transistor 64 and the condenser 65. The output terminal of this amplifier 60 is also connected to its negative input terminal and the negative input terminal of the second operational amplifier 34 so as to produce a negative feedback.

The reset circuit 56 comprises a transistor 67, a resistance 68 connected to an emitter of the transistor 67, two resistances 69 and 70 connected in series to the base of the transistor 67. The resistance 70 is connected to the battery 28. In this construction, a collector of the transistor 67 is connected to the positive input terminal of the amplifier 60 in the constant current integrator circuit 55.

The positive input terminal of the other amplifier 58 is, on the other hand, connected to the battery 71. The negative input terminal of this amplifier 58 is connected to the output terminal of the first diode 31 in the first comparator circuit 18*a*. The output terminal of this amplifier 58 is connected between the two resistances 69 and 70 in the reset circuit 56 through the diode 57.

As above, the second comparator 18*b* is constituted. The ignition device in this embodiment differs in the above mentioned construction from that in the second embodiment.

Next, the operation of the engine ignition device constituted as described above will be described.

As shown in FIG. 11, the flywheel 6 is rotated counterclockwise (in the direction indicated by an arrow) along with the crankshaft 5, whereby the protrusion 19 is revolved. When the protrusion 19 passes near the magnet pickup 21, the magnet pickup 21 outputs the detection signal of a substantially sinusoidal waveform having the peak value Vp in response to the passing speed of the protrusion 19, i.e., the rotational speed of the engine 1. The first diode 31 rectifies this detection signal and outputs it to the first operational amplifier 33 and the other operational amplifier 58. The first operational amplifier 33 compares the rectified signal to a predetermined threshold value Vth. The other operational amplifier 58 compares the rectified signal to a set voltage.

At this time, when the rectified signal exceeds the threshold value Vth in the first operation amplifier 33, the amplifier 33 outputs a low-level signal. The first inverter 37 inverts the output signal to a high-level signal and outputs the high-level signal. When this high-level signal is inputted to the reset input terminal of the flip-flop 39, the flip-flop 39 outputs the low-level signal from the inverse output terminal to the transistor 40. When the transistor 40 receives this signal and is turned off, the current is applied to the primary coil 15*a* of the ignition coil 15. At this time, the high voltage is induced by the secondary coil 15*b*. When the high voltage is supplied to the spark plug 14, the sparks are emitted by the spark plug 14. When these sparks are emitted in the compression step of the engine 1, the fuel-air mixture introduced in the combustion chamber 7 is ignited. The fuel-air mixture is then exploded and combusted. Thereby, the piston 3 is pushed down so that a torque is applied to the engine 1.

On the other hand, in the constant current integrator circuit 55 of the second comparator circuit 18*b*, the condenser 65 is always charged at a constant current. The change in voltage caused by the charge is outputted to the second operational amplifier 34 through the operational amplifier 60. At this time, when the voltage inputted to the other operational amplifier 58 as well as the first operational amplifier, as mentioned above, exceeds the set voltage in the battery 71, the operational amplifier 58 outputs a low-level signal. The inverter 57 inverts the output signal to a high-level signal and outputs the high-level signal. When this high-level signal is inputted to the reset circuit 56, whereby the transistor 67 in the same circuit 57 is turned on. When this transistor 67 is turned on, the condenser 65 in the constant current integrator circuit 55 is allowed to discharge electricity. The change in voltage caused by the discharge is outputted to the second operational amplifier 34 through the operational amplifier 60. At this time, when the changed voltage inputted to the second operational amplifier 34 exceeds the threshold value Vth, the amplifier 34 inverts the output signal to a high-level signal and outputs the high-level signal. This high-level signal is converted to a single pulse signal in synchronization with the leading edge of the signal by the diode 51, the resistance 54, the condenser 52, and the amplifier 53. This timing of outputting the pulse signal is made later by a predetermined period than the timing of outputting the high-level signal from the first comparator circuit 18*a* to the flip-flop 39. Here, the relationship between the above signals is conceptually shown in the time charts of FIGS. 13(*a*) to 13(*d*).

When the above pulse signal is inputted to the reset input terminal of the flip-flop 39, this flip-flop 39 outputs the high-level signal from its inverse output terminal to the transistor 40. When the transistor 40 receives the signal and is turned on, the current if applied to the primary coil 15*a* of the ignition coil 15. That is, after the lapse of a predetermined time from the interruption of current to the ignition coil 15 in order to carry out this ignition by the spark plug 14, the ignition coil 15 is applied with the current for preparation of the next ignition.

Accordingly, the ignition device in the third embodiment can basically provide the operation and effect equal to those in the first and second embodiments. In addition, in the third embodiment, applying current to the ignition coil 15 and interrupting the current applied to the ignition coil 15 can be made by one magnet pickup 21 alone. In this sense, compared with the ignition device in the first embodiment requiring the two magnet pickups 21 and 22, the mechanical construction of the ignition device in this embodiment can be more simplified.

Next, a fourth embodiment of the engine ignition device of the present invention will be described with reference to FIGS. 14 through 17.

Figure 14:
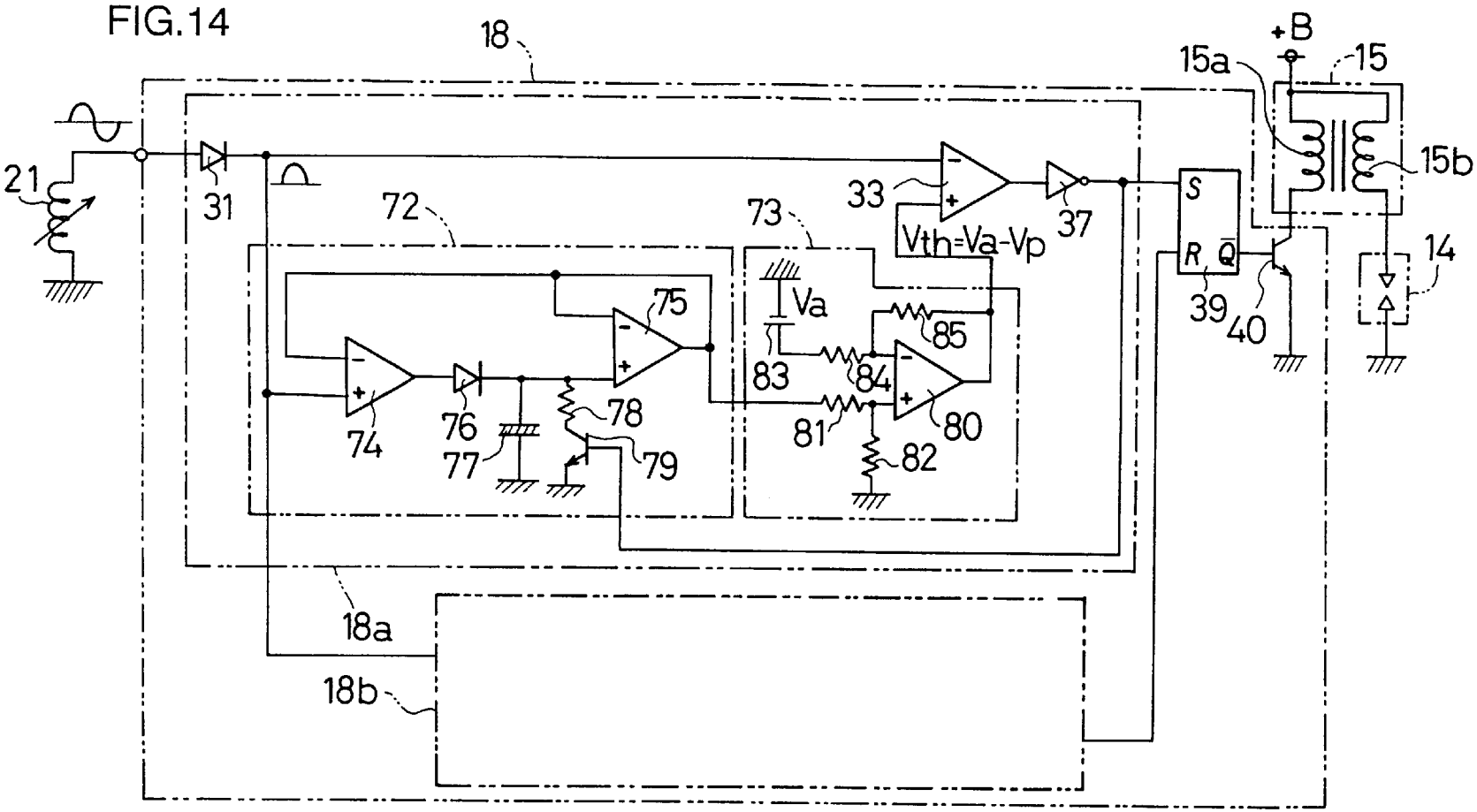
FIG. 14 is an electrical circuit diagram showing an electrical constitution of the ignition device in a fourth embodiment.

In the above-described embodiments, the detection signal of the rotation sensors 16 and 17 is compared to the constant threshold value Vth, whereby the operating timing of the spark plug 14 is determined. On the other hand, this embodiment differs from the above-described embodiments in that the threshold value vth to be compared to the detection signal of the rotation sensor 16 is variable. FIG. 14 shows the electrical constitution of the ignition device including the ECU 18. This embodiment differs from the third embodiment in this electrical constitution.

As shown in FIG. 14, the ECU 18 has the first comparator circuit 18a and the second comparator circuit 18*b*. Since the constitution of the second comparator circuit 18*b* is the same as that of the third embodiment, the detailed illustration and description are omitted. The constitution of the first comparator circuit 18*a* will be mainly described below.

That is, the first comparator circuit 18*a* has a peak value holding circuit 72 and a differential amplifier circuit 73 as well as the first diode 31, the operational amplifier 33 and the inverter 37.

The peak value holding circuit 72 has two operational amplifiers 74 and 75. The positive input terminal of the one operational amplifier 74 is connected to the output side of the first diode 31. The output terminal of the operational amplifier 74 is connected to the positive input terminal of the other operational amplifier 75 through a diode 76. A capacitor 77 is connected in parallel to the output side of the diode 76. Furthermore, a resistance 78 and a transistor 79 connected in series are connected between the capacitor 77 and the other operational amplifier 75. The base of the transistor 79 is connected to the output side of the first inverter 37. The output terminal of the other operational amplifier 75 is connected to the differential amplifier circuit 73. This output terminal is also connected to its negative input terminal and the negative input terminal of the one operational amplifier 74 so as to produce a negative feedback.

The differential amplifier circuit 73 includes one operational amplifier 80. A pair of resistances 81 and 82 connected in parallel is connected to the positive input terminal of this operational amplifier 80. The output terminal of the other operational amplifier 75 of the holding circuit 72 is connected to the one resistance 81. A battery 83 and a resistance 84 connected in series are connected to the negative input terminal of the operational amplifier 80. Thereby, the voltage of a predetermined reference value Va is inputted to the negative input terminal of the operational amplifier 80. The output terminal of the operational amplifier 80 is connected to the positive input terminal of the first operational amplifier 33. This output terminal is also connected to its negative input terminal through a resistance 85 so as to produce the negative feedback. In this embodiment, the peak value holding circuit 72 and the differential amplifier circuit 73 constitute a threshold value changing circuit. As the peak value Vp of the detection signal becomes larger, the threshold value changing circuit changes the threshold value Vth, which is compared to the detection signal so that the threshold value Vth may be relatively small.

Next, the operation of the ignition device constituted as described above will be described.

When the protrusion 19 is revolved with the rotation of the crankshaft 5, the magnet pickup 21 outputs the detection signal of the substantially sinusoidal waveform having the peak value Vp in response to the passing speed of the protrusion 19, i.e., the rotational speed of the engine 1. At this time, the first diode 31 rectifies this detection signal and outputs the rectified signal to the first operational amplifier 33 and the operational amplifier 74 of the holding circuit 72.

Figure 15:
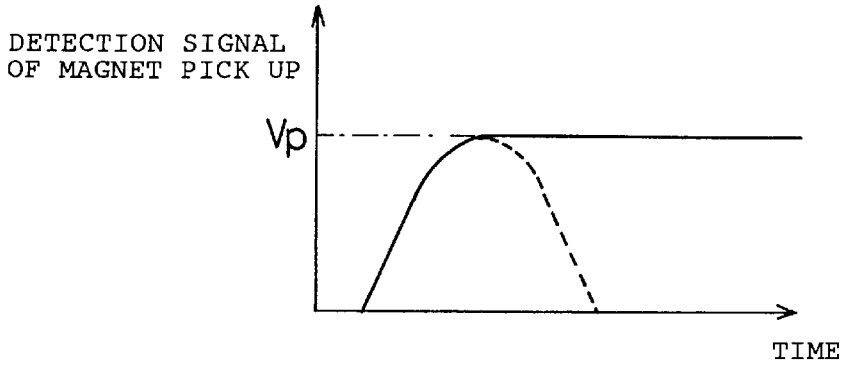
FIG. 15 is a time chart showing a detection signal outputted from magnet pickups, which is kept at a peak value Vp.

When the peak value holding circuit 72 receives the rectified signal from the first diode 31, the circuit 72 outputs the held peak value Vp of the detection signal (rectified signal) of the magnet pickup 21, as shown in FIG. 15. The differential amplifier circuit 73 compares this peak value Vp to a predetermined reference value Va. The circuit 73 outputs the difference between the values (Va−Vp) as the threshold value Vth to the first operational amplifier 33.

Figure 16:
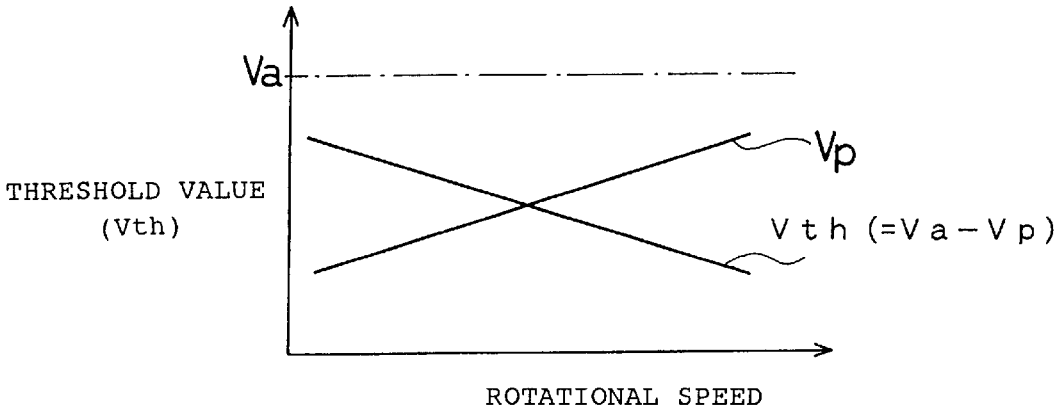
FIG. 16 is a graph showing the relationship between a rotational speed, reference values, a peak value and a threshold value.

The threshold value vth outputted from the differential amplifier circuit 73 is the difference between the reference value Va and the peak value Vp. Thus, the change in the rotational speed of the engine 1 allows the peak value Vp to be changed. FIG. 16 shows the relationship between the rotational speed of the engine 1 and these reference value Va, peak value Vp and threshold value Vth. As can be seen from this graph, the higher the rotational speed is, the higher the peak value Vp is. However, the higher the rotational speed is, the lower the threshold value Vth is. In this manner, in this embodiment, the threshold value Vth is changed in response to the difference in the rotational speed of the engine 1. As can be seen from the graph of FIG. 8 discussed previously, the reduction of the threshold value Vth allows the degree of advance of the ignition timing to be relatively advanced, while the increase of the threshold value Vth allows the degree of advance of the ignition timing to be relatively delayed.

The first operational amplifier 33 compares the rectified signal from the first diode 31 to the threshold value Vth from the differential amplifier circuit 73. When the rectified signal exceeds the threshold value Vth, the high-level signal is outputted to the flip-flop 39 through the first inverter 37. Thereby, the ignition coil 15 is actuated so that the sparks are emitted to the spark plug 14. At the same time, the transistor 79 of the holding circuit 72 is turned on in accordance with the output signal from the first inverter 37, so that the peak value Vp held by the holding circuit 72 is reset.

As described above, according to this embodiment, as the peak value Vp of the detection signal of the magnet pickup 21 is higher, that is, as the rotational speed of the engine 1 is higher, the threshold value Vth is changed so that it may be relatively low. Thus, the higher the rotational speed is, the relatively lower the threshold value Vth is. The detection signal exceeds the threshold value Vth at the relatively early timing to the rotation cycle of the crankshaft 5. On the other hand, the lower the rotational speed of the crankshaft 5 is, the relatively higher the threshold value Vth is. The detection signal exceeds the threshold value Vth at the relatively late timing to the rotation cycle of the crankshaft 5.

Figure 17:
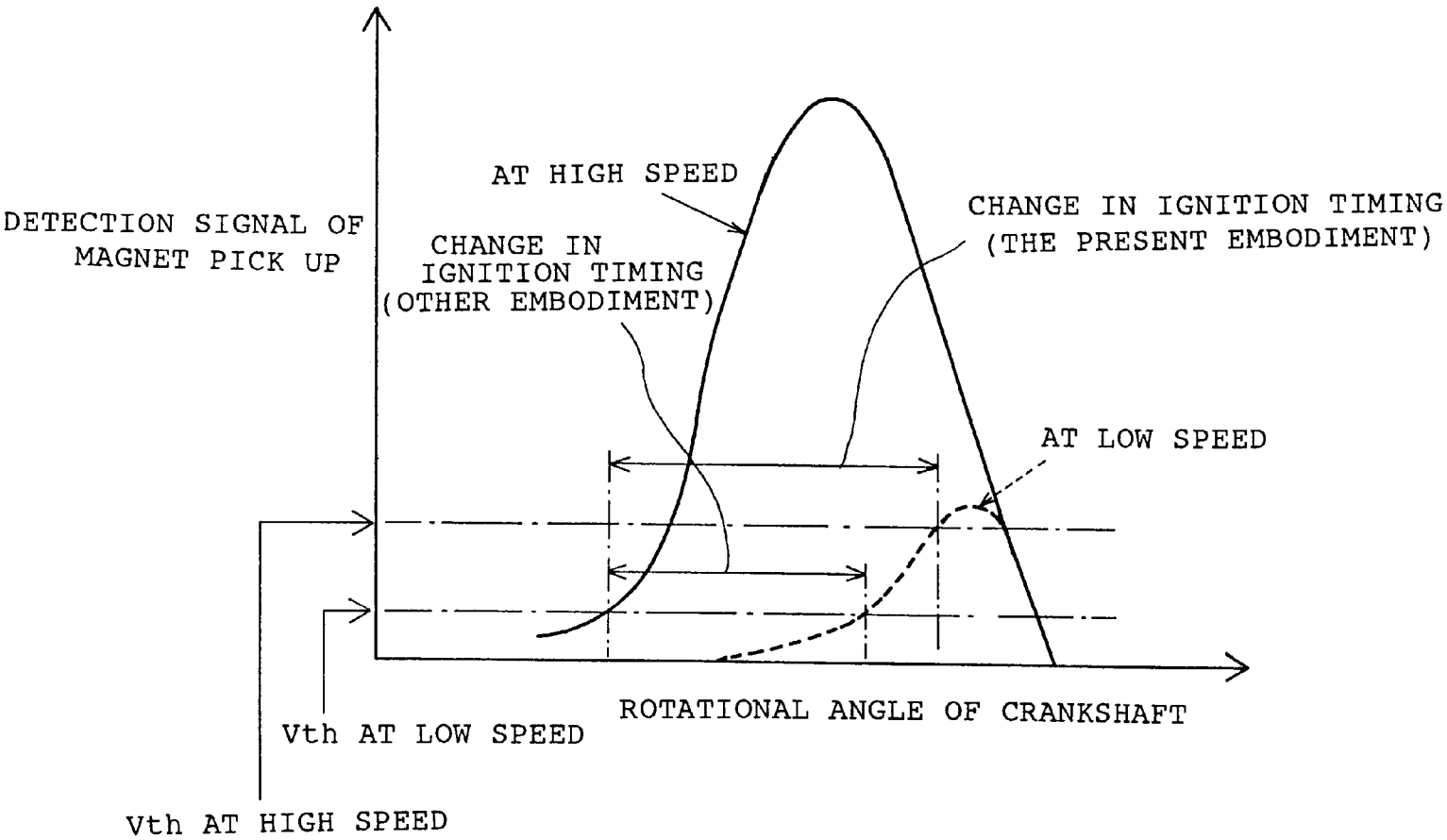
FIG. 17 is a graph showing difference in the threshold value and difference in a range of change in the ignition timing, between a low-speed operation and a high-speed operation.

FIG. 17 shows the difference in the threshold value Vth and the difference in the range of the change in the ignition timing, between the low-speed operation and the high-speed operation of the engine 1. As can be seen from this graph, the range of the change in the ignition timing for the variable threshold value Vth (this embodiment) is relatively wider than the range of the change in the ignition timing for the constant threshold value Vth (other embodiments). According to the constitution of this embodiment, the ignition timing of the fuel-air mixture in the combustion chamber 7 is therefore advanced or delayed within the wider range. The combustion timing of the fuel-air mixture is thus adapted to the operation condition of the engine 1. In this sense, the ignition timing can be automatically controlled in the stable manner in response to the difference in the rotational speed of the engine 1 within the wider variable range than the range of the above-mentioned embodiments by the relatively simple constitution.

In this embodiment, the functions and effects other than the above-mentioned function and effect are basically the same as those of the third embodiment.

Next, a fifth embodiment of the engine ignition device of the present invention will be described with reference to FIGS. 18 through 25.

In the following plural embodiments including this embodiment, the same elements as the first embodiment have the same reference numerals, and the description is omitted. Accordingly, the following embodiments will be described mainly in the differences between these embodiments and the first embodiment.

Figure 18:
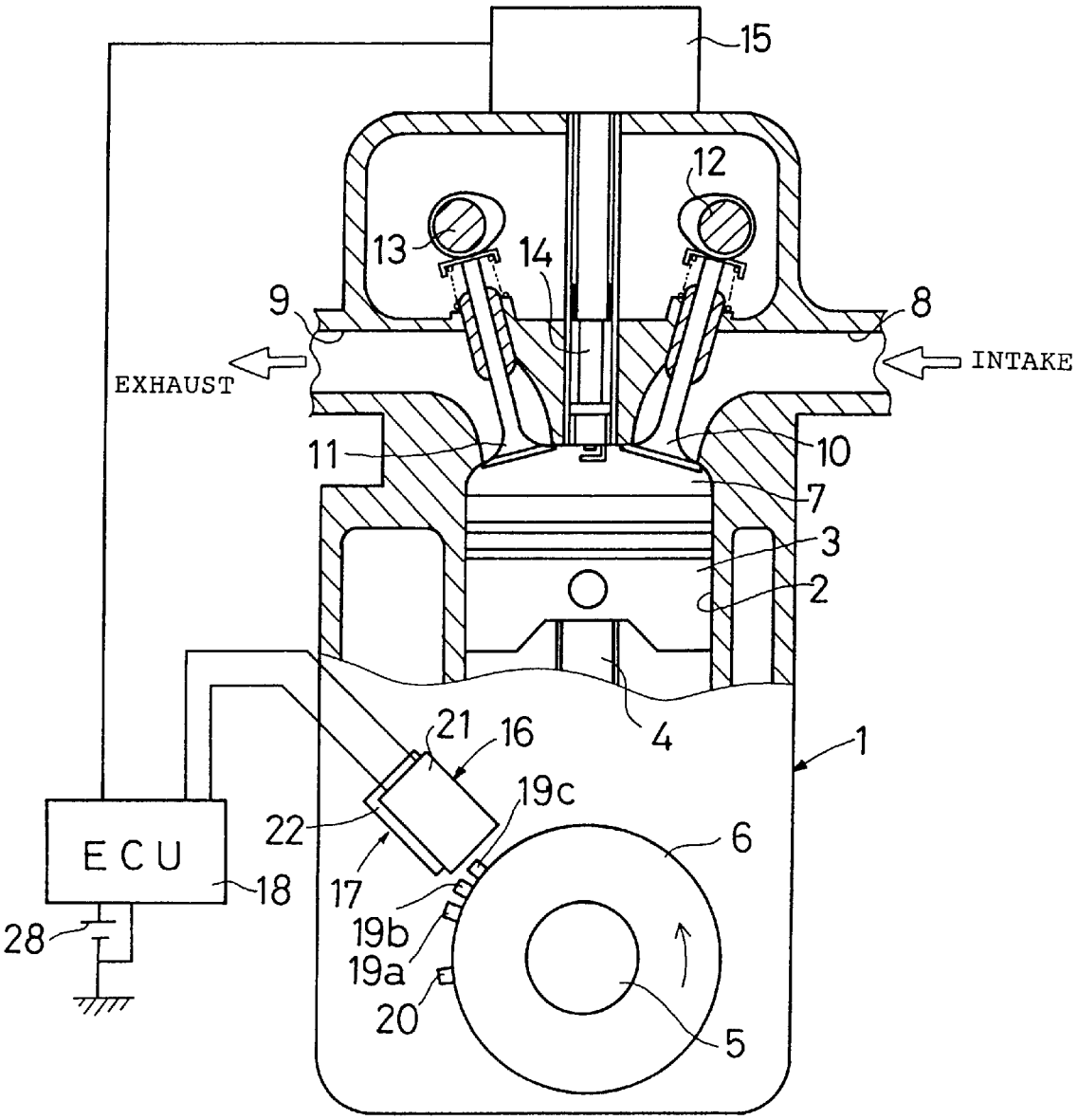
FIG. 18 is a schematic constitution showing an engine and an ignition device for the engine in a fifth embodiment according to the present invention.
Figure 19:
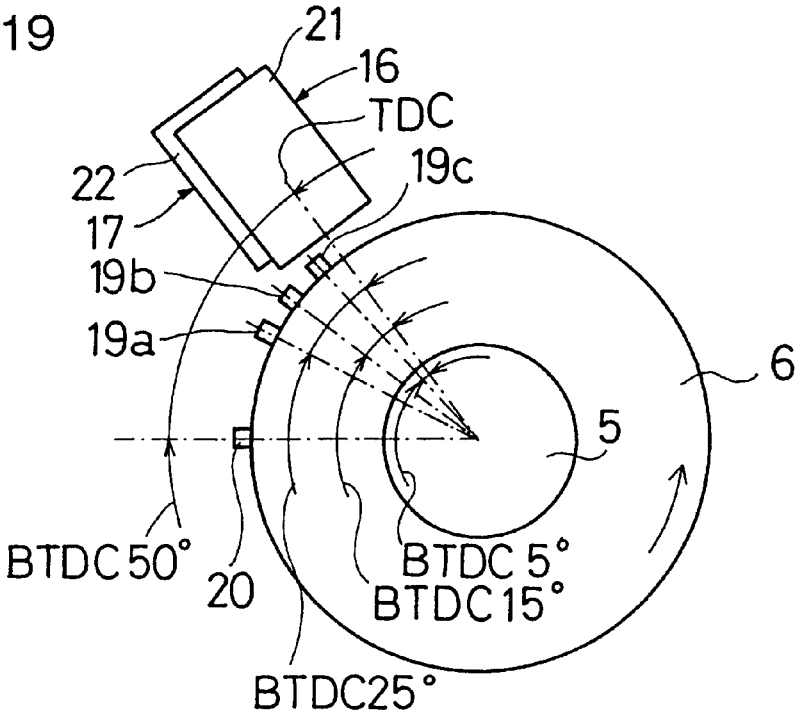
FIG. 19 is a conceptual front view showing arrangement of protrusions and magnet pickups on a flywheel.
Figure 20:
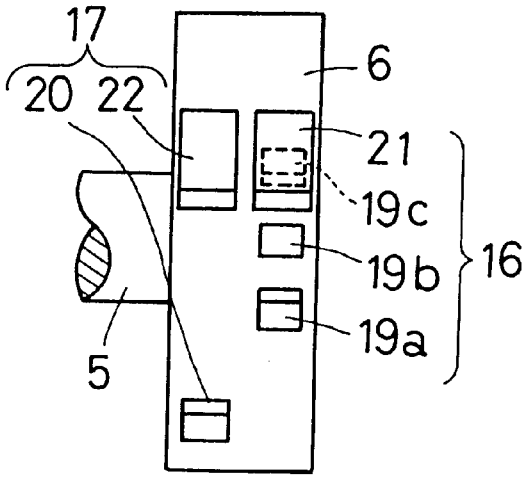
FIG. 20 is a conceptual side view showing arrangement of the protrusions and the magnet pickups on the flywheel.

FIG. 18 shows a schematic constitution of the engine 1 of this embodiment and the ignition device for the engine 1. FIG. 19 is a front view showing the relationship of the arrangement of the flywheel 6 and the rotation sensors 16 and 17. Similarly, FIG. 20 is a side view showing the relationship of the arrangement of the flywheel 6 and the rotation sensors 16 and 17. As shown in FIGS. 18 through 20, the first rotation sensor 16 intermittently detects the rotation of the crankshaft 5 at each of a plurality of preset rotational angles. The rotation sensor 16 sequentially outputs, in the pulse manner, the detection signal having the maximum value (peak value) in response to the rotational speed of the crankshaft 5, i.e., the rotational speed of the engine 1. In this embodiment, a plurality of rotational angles are defined on the basis of a position TDC corresponding to a top dead center of the piston 3. That is, these angles are a rotational angle (BTDC5°) of 5 degrees ahead of the position TDC, a rotational angle (BTDC15°) of 15 degrees ahead of the position TDC and a rotational angle (BTDC25°) of 25 degrees ahead of the position TDC. These angles are used as a plurality of rotational angles.

The first rotation sensor 16 includes a series of first, second and third protrusions 19*a*, 19*b* and 19*c* disposed on the same revolution locus on the outer periphery of the flywheel 6; and the first magnet pickup 21 corresponding to the protrusions 19*a* through 19*c*. The first magnet pickup 21 is adjacent to the revolution locus of the protrusions 19*a* through 19*c*. When the protrusions 19*a* through 19*c* pass near the magnet pickup 21, the magnet pickup 21 sequentially outputs, in the pulse manner, three detection signals having the peak value Vp proportional to their passing speed. That is, the first magnet pickup 21 sequentially outputs the detection signals corresponding to the positions of BTDC5°, BTDC15° and BTDC25° with the rotation of the crankshaft 5. The first rotation sensor 16 is used for detecting the timing of the interruption of the current applied to the primary coil 15*a* of the ignition coil 15 in order to supply the high voltage to the spark plug 14.

As shown in FIGS. 18 through 20, the second rotation sensor 17 detects the rotation of the crankshaft 5 at each preset rotational angle (a rotational angle (BTDC50°) of 50 degrees ahead of the position TDC corresponding to the top dead center of the piston 3 in this embodiment). The rotation sensor 17 outputs, in an impulse manner, the detection signal having the maximum value (peak value) in response to the rotational speed of the engine 1.

The second rotation sensor 17 includes a fourth protrusion 20 disposed on a different revolution locus aligned with the protrusions 19*a* through 19*c* on the outer periphery of the flywheel 6; and the second magnet pickup 22 corresponding to the protrusion 20. This magnet pickup 22 is adjacent to the revolution locus of the fourth protrusion 20. When the protrusion 20 passes near the magnet pickup 22, the magnet pickup 22 outputs, in the impulse manner, the detection signal having the peak value Vp proportional to its passing speed. The second magnet pickup 22 is used for detecting the timing of the start of the application of the current to the primary coil 15*a* previous to the interruption of the current applied to the primary coil 15*a*.

Figure 21:
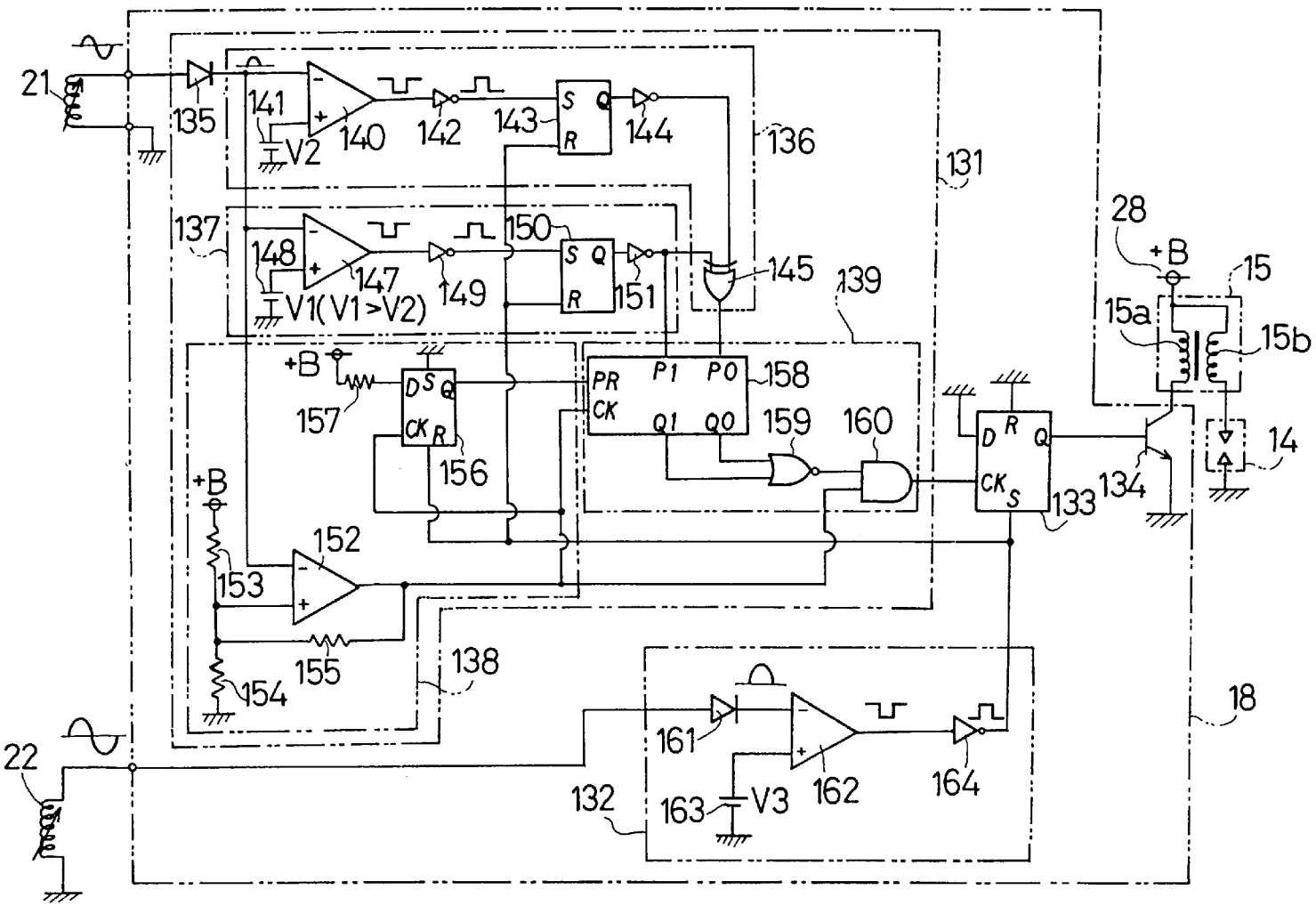
FIG. 21 is an electrical circuit diagram showing an electrical constitution of the ignition device in the fifth embodiment.

The magnet pickups 21 and 22 are connected to the ECU 18. The battery 28 is connected to the ECU 18. FIG. 21 shows the electrical constitution of the ignition device including the ECU 18. This ECU 18 comprises a first decision circuit 131, a second decision circuit 132, a last-stage flip-flop 133 and a transistor 134.

The first decision circuit 131 includes a first diode 135, a first comparator circuit 136, a second comparator circuit 137, a third comparator circuit 138 and a selector circuit 139. The first comparator circuit 136 includes a first operational amplifier 140, a first battery 141, an inverter 142, a first flip-flop 143, an inverter 144 and an exclusive OR circuit 145. The second comparator circuit 137 includes a second operational amplifier 147, a second battery 148, an inverter 149, a second flip-flop 150 and an inverter 151. The third comparator circuit 138 includes a third operational amplifier 152, three resistances 153, 154 and 155, a third flip-flop 156 and a resistance 157. Furthermore, the selector circuit 139 includes a counter 158, a NOR circuit 159 and an AND circuit 160.

The first magnet pickup 21 is connected to the negative input terminals of the first to third operational amplifiers 140, 147 and 152 through the first diode 135. In the first comparator circuit 136, the first battery 141 is connected to the positive input terminal of the first operational amplifier 140. This battery 141 is used for determining a relatively low threshold value V2 to be compared to the detection signal of the first magnet pickup 21. The output terminal of this operational amplifier 140 is connected to the input terminal (S) of the first flip-flop 143 through the inverter 142. The output terminal (Q) of this flip-flop 143 is connected to one input terminal of the exclusive OR circuit 145 through the inverter 144. The output terminal of the exclusive OR circuit 145 is connected to the input terminal (P0) of the counter 158.

In the second comparator circuit 137, the second battery 148 is connected to the positive input terminal of the second operational amplifier 147. The battery 148 is used for determining a relatively high threshold value V1 (V1>V2) to be compared to the detection signal of the first magnet pickup 21. The output terminal of this operational amplifier 147 is connected to the input terminal (S) of the second flip-flop 150 through the inverter 149. The output terminal (Q) of this flip-flop 150 is connected to the other input terminal of the exclusive OR circuit 145 and the input terminal (P1) of the counter 158 through the inverter 151.

In the third comparator circuit 138, one end of the two resistances 153 and 154 connected in series is connected to the battery 28, while the other end thereof is earthed. The positive input terminal of the third operational amplifier 152 is connected between both the resistances 153 and 154. The output terminal of the operational amplifier 152 is connected to the input terminals (CK) of the third flip-flop 156 and the counter 158 and also connected to one input terminal of the AND circuit 160. Furthermore, the output terminal of this operational amplifier 152 is connected between both the resistances 153 and 154. The input terminal (D) of the third flip-flop 156 is connected to the battery 28 through the resistance 157, while another input terminal (S), is earthed. The output terminal (Q) thereof is connected to the input terminal (PR) of the counter 158.

In the selector circuit 139, both the output terminals (Q0, Q1) of the counter 158 are connected to the input terminal of the NOR circuit 159. The output terminal of this NOR circuit 159 is connected to the other input terminal of the AND circuit 160. The output terminal of the AND circuit 160 is connected to the input terminal (CK) of the last-stage flip-flop 133.

On the other hand, the second decision circuit 132 includes a second diode 161, a fourth operational amplifier 162, a third battery 163 and an inverter 164. In the second decision circuit 132, the second magnet pickup 22 is connected to the negative input terminal of the fourth operational amplifier 162 through the second diode 161. The third battery 163 is connected to the positive input terminal of this operational amplifier 162. The battery 163 is used for determining a threshold value V3 to be compared to the detection signal of the second magnet pickup 22. The output terminal of this operational amplifier 162 is connected to the input terminals (R) of the first to third flip-flops 143, 150 and 156 and the input terminal (S) of the last-stage flip-flop 133 through the inverter 164.

In this embodiment, the second magnet pickup 22, the second decision circuit 132, the last-stage flip-flop 133 and the transistor 134 constitute the current applying device for starting the application of the current to the primary coil 15*a* previous to the interruption of the current applied to the primary coil 15*a*. In this constitution, the second decision circuit 132, the flip-flop 133 and the transistor 134 constitute the current applying circuit. On the other hand, the first magnet pickup 21, the first decision circuit 131, the flip-flop 133 and the transistor 134 constitute the interrupting device for interrupting the current applied to the primary coil 15*a*. In this constitution, the first decision circuit 131, the flip-flop 133 and the transistor 134 constitute the interrupting circuit.

The input terminals (D) and (R) of the last-stage flip-flop 133 are earthed and the output terminal (Q) thereof is connected to the base of the transistor 134. The collector of the transistor 134 is connected to the primary coil 15*a* of the ignition coil 15. The ignition coil 15 is connected to the battery 28. The secondary coil 15*b* of the ignition coil 15 is connected to the spark plug 14.

Next, the operation of the engine ignition device constituted as described above will be described.

During the operation of the engine 1, the crankshaft 5 is rotated so that the flywheel 6 is rotated counterclockwise (in the direction indicated by the arrow) in FIGS. 18 and 19, whereby the protrusions 19*a* to 19*c* and 20 are revolved together. When the fourth protrusion 20 passes near the second magnet pickup 22, the magnet pickup 22 outputs the detection signal of the substantially sinusoidal waveform having the peak value Vp in response to the passing speed of the protrusion 20, i.e., the rotational speed of the crankshaft 5 (the rotational speed of the engine 1). The second diode 161 rectifies this detection signal. The fourth operational amplifier 162 compares the rectified signal to a predetermined threshold value V3. When the rectified signal exceeds the threshold value V3, the fourth operational amplifier 162 outputs the low-level signal. The inverter 164 inverts the output signal to the high-level signal and outputs the high-level signal. When this high-level signal is inputted to the input terminal (S) of the last-stage flip-flop 133, the flip-flop 133 outputs the high-level signal from the output terminal (Q) to the transistor 134. When the transistor 134 receives this signal and is turned on, the current is applied to the primary coil 15*a* of the ignition coil 15. Furthermore, the signal outputted from the inverter 164 is inputted to the input terminals (R) of the first to third flip-flops 143, 150 and 156.

Then, slightly late, the first to third protrusions 19*a* to 19*c* sequentially pass near the first magnet pickup 21. At this time, the magnet pickup 21 sequentially outputs a series of detection signals of the substantially sinusoidal waveform having the peak value Vp in response to the rotational speed of the crankshaft 5. The first diode 135 rectifies these detection signals. The first and second operational amplifiers 140 and 147 compare the rectified signals to the predetermined threshold values V2 and V1. The third operational amplifier 152 compares the rectified signals to a predetermined reference value defined by the resistances 153 and 154.

In the first comparator circuit 136, when the rectified signal exceeds the threshold value V2, the first operational amplifier 140 outputs the low-level signal. The inverter 142 inverts the output signal to the high-level signal and outputs the high-level signal. When this high-level signal is inputted to the input terminal (S) of the first flip-flop 143, the flip-flop 143 outputs the high-level signal from the output terminal (Q). This high-level signal is inverted by the inverter 144. The inverted signal is then inputted to the exclusive OR circuit 145.

Similarly, in the second comparator circuit 137, when the rectified signal exceeds the threshold value V1, the second operational amplifier 147 outputs the low-level signal. The inverter 149 inverts the output signal to the high-level signal and outputs the high-level signal. When this high-level signal is inputted to the input terminal (S) of the second flip-flop 150, the flip-flop 150 outputs the high-level signal from the output terminal (Q). This high-level signal is inverted by the inverter 151. The inverted signal is then inputted to the exclusive OR circuit 145 and the counter 158.

Furthermore, in the third comparator circuit 138, when the rectified signal exceeds a predetermined reference value, the third operational amplifier 152 outputs the low-level signal. This low-level signal is inputted to the input terminals (CK) of the third flip-flop 156 and the counter 158 and also inputted to the AND circuit 160. When the low-level signal is inputted to the input terminal (CK) of the flip-flop 156, the flip-flop 156 outputs the high-level signal to the input terminal (PR) of the counter 158 in synchronization with the leading edge of the signal. When the high-level signal is inputted to the input terminal (PR) of the counter 158, the counter 158 sets the values of both the input terminals (P0, P1) of the counter 158.

The low-level signal is then inputted to the NOR circuit 159 from both the output terminals (Q0, Q1) of the counter 158. The high-level signal is inputted to the AND circuit 160 from the NOR circuit 159. The high-level signal is also inputted to the AND circuit 160 from the third operational amplifier 152. Thereby, the high-level signal is inputted to the input terminal (CK) of the last-stage flip-flop 133 from the AND circuit 160. The flip-flop 133 causes the output signal to fall with the first leading edge of this signal. When the transistor 134 receives this signal and is turned off, the current applied to the primary coil 15*a* is interrupted. At this time, the high voltage is induced by the secondary coil 15*b*. When the high voltage is supplied to the spark plug 14, the sparks are emitted by the spark plug 14. When these sparks are emitted in the compression step of the engine 1, the fuel-air mixture introduced in the combustion chamber 7 is ignited. The fuel-air mixture is then exploded and combusted. Thereby, the piston 3 is pushed down so that the torque is applied to the crankshaft 5. The crankshaft 5 is thus rotated so that the driving force is applied to the engine 1. Although these sparks are also emitted in the exhaust step of the engine 1, the sparks are the ineffective sparks at that time.

The relationship among the above-described signals is shown in the time charts of FIGS. 22 through 24. The time charts are classified by the difference in a magnitude of the peak values Vp of the detection signals outputted from the first magnet pickup 21 for a series of protrusions 19*a* to 19*c*.

FIG. 22 shows the case where the peak value Vp is higher than the high threshold value V1 (V1<Vp), i.e., the case where the rotational speed of the engine 1 is relatively high. In this case, the relationship between the outputs of the first and second flip-flops 143 and 150 and the inputs of both the input terminals (P0, P1) of the counter 158 is shown in row 3 in a table of FIG. 25.

In this case, first, in the position of BTDC50°, the fourth protrusion 20 is detected by the second magnet pickup 22, whereby the high-level signal is outputted from the last-stage flip-flop 133. Thus, the application of the current to the ignition coil 15 is started. Immediately after that, with the input of the serial detection signals, the signals, which are outputted from the third operational amplifier 152 and intermittently switched between the low level and the high level, are inputted to the input terminal (CK) of the third flip-flop 156. At this time, the output of the flip-flop 156 is switched from the low level to the high level in synchronization with the leading edge of the first signal. Thereby, the input of the input terminal (PR) of the counter 158 is switched from the low level to the high level. The values of both the input terminals (P0, P1) are thus set in the counter 158. Here, since both the values are at the low level, the output of the NOR circuit 159 remains at the high level and unchanged. At this time, the signal inputted to the AND circuit 160 from the third operational amplifier 152 is switched from the low level to the high level for the first time by the detection of the first protrusion 19*a*. Thereby, the high-level signal is outputted to the last-stage flip-flop 133 from the AND circuit 160. The flip-flop 133 receives this signal and switches the output from the high level to the low level. The transistor 134 is then turned off, and thus the current applied to the primary coil 15*a* is interrupted, so that the ignition is performed by the spark plug 14. In this manner, when the rotational speed of the engine 1 is relatively high, the detection of the first protrusion 19*a* located in BTDC25° allows the ignition to be performed. Thus, the ignition timing is relatively advanced.

FIG. 23 shows the case where the peak value Vp is lower than the high threshold value V1 and is higher than the low threshold value V2 (V2<Vp<V1), i.e., the case where the rotational speed of the engine 1 is substantially intermediate. In this case, the relationship between the outputs of the first and second flip-flops 143 and 150 and the inputs of both the input terminals (P0, P1) of the counter 158 is shown in row 2 in the table of FIG. 25.

In this case, in the same manner as described above, in the position of BTDC50°, the detection of the fourth protrusion 20 allows the application of the current to the ignition coil 15 to be started. Immediately after that, with the input of the serial detection signals, the signals, which are outputted from the third operational amplifier 152 and intermittently switched between the low level and the high level, are inputted to the input terminal (CK) of the third flip-flop 156. At this time, the output of the flip-flop 156 is switched from the low level to the high level in synchronization with the leading edge of the first signal. Thereby, the input of the input terminal (PR) of the counter 158 is switched from the low level to the high level. The values of both the input terminals (P0, P1) are thus set in the counter 158. Here, since the value of the input terminal (P0) is at the high level and the value of the input terminal (P1) is at the low level, the output of the output terminal (Q0) of the counter 158 is at the high level and the output of the output terminal (Q1) thereof is at the low level. As a consequence, the output signal of the NOR circuit 159 falls from the high level to the low level. At the same time when the counter 158 terminates a count, the output signal rises from the low level to the high level. At this time, the signal inputted to the AND circuit 160 from the third operational amplifier 152 is switched from the low level to the high level for the second time by the detection of the second protrusion 19*b*. Thereby, the high-level signal is outputted to the last-stage flip-flop 133 from the AND circuit 160. The flip-flop 133 receives this signal and switches the output from the high level to the low level. The transistor 134 is then turned off, and thus the current applied to the primary coil 15*a* is interrupted, so that the ignition is performed by the spark plug 14. In this manner, when the rotational speed of the engine 1 is substantially intermediate, the detection of the second protrusion 19*b* located in BTDC15° allows the ignition to be performed. Thus, the ignition timing is adjusted.

FIG. 24 shows the case where the peak value Vp is lower than the low threshold value V2 (Vp<V2), i.e., the case where the rotational speed of the engine 1 is relatively low. In this case, the relationship between the outputs of the first and second flip-flops 143 and 150 and the inputs of both the input terminals (P0, P1) of the counter 158 is shown in row 1 in the table of FIG. 25.

In this case, in the same manner as described above, in the position of BTDC50°, the detection of the fourth protrusion 20 allows the application of the current to the ignition coil 15 to be started. Immediately after that, with the input of the serial detection signals, the signals, which are outputted from the third operational amplifier 152 and intermittently switched between the low level and the high level, are inputted to the input terminal (CK) of the third flip-flop 156. At this time, the output of the flip-flop 156 is switched from the low level to the high level in synchronization with the leading edge of the first signal. Thereby, the input of the input terminal (PR) of the counter 158 is switched from the low level to the high level. The values of both the input terminals (P0, P1) are thus set in the counter 158. Here, since the value of the input terminal (P0) is at the low level and the value of the input terminal (P1) is at the high level, the output of the output terminal (Q0) of the counter 158 is at the low level and the output of the output terminal (Q1) thereof is at the high level. As a result, the output signal of the NOR circuit 159 falls from the high level to the low level. At the same time when the counter 158 terminates the count, the output signal rises from the low level to the high level. At this time, the signal inputted to the AND circuit 160 from the third operational amplifier 152 is switched from the low level to the high level for the third time by the detection of the third protrusion 19*c*. Thereby, the high-level signal is outputted to the last-stage flip-flop 133 from the AND circuit 160. The flip-flop 133 receives this signal and switches the output from the high level to the low level. The transistor 134 is then turned off, and thus the current applied to the primary coil 15*a* is interrupted, so that the ignition is performed by the spark plug 14. In this manner, when the rotational speed of the engine 1 is relatively low, the detection of the third protrusion 19*b* located in BTDC5° allows the ignition to be performed. Thus, the ignition timing is relatively delayed.

As described above, when the rotational speed of the crankshaft 5 is changed during the operation of the engine 1, the peak values Vp of the detection signals sequentially outputted from the first magnet pickup 21 are changed. The ECU 18 determines that a series of peak values Vp sequentially outputted from the first magnet pickup 21 has the magnitude previously set in response to the order of output. In this case, the time of determination is regarded as the ignition timing in the rotation cycle of the crankshaft 5 at this time, so that the spark plug 14 is controlled through the ignition coil 15. The ignition timing of the fuel-air mixture in the combustion chamber 7 of the engine 1 is therefore advanced or delayed. The combustion timing of the fuel-air mixture can be thus changed in response to the difference in the operation conditions such as the low-speed operation or the high-speed operation of the engine 1.

More specifically, when the flywheel 6 is rotated with the crankshaft 5, the protrusions 19*a* to 19*c* pass near the first magnet pickup 21. The magnet pickup 21 then outputs, in the pulse manner, the detection signals having the peak values Vp proportional to their passing speed, i.e., the rotational speed of the engine 1. At this time, the first decision circuit 131 compares the peak values Vp of the detection signals to the threshold value ranges set in response to the order of output, i.e., "a low threshold value range (Vp<V2)" lower than the low threshold value V2, "an intermediate threshold value range (V2<Vp<V1)" between the low threshold value V2 and the high threshold value V1 and "a high threshold value range (Vl<Vp)" higher than the high threshold value V1. Then, when a determination is made that each peak value Vp is adapted to any one of the above-described threshold value ranges, a decision is made that the time of determination is the operating timing for operating the spark plug 14, namely, the ignition timing.

In this embodiment, the threshold value range in response to the peak value Vp of the detection signal outputted in the relatively early order to the rotation cycle of the crankshaft 5, i.e., the detection signal associated with the first protrusion 19*a* is set as the high threshold value range (V1<Vp). The threshold value range in response to the peak value Vp of the detection signal associated with the second protrusion 19*b* is set as the intermediate threshold value range (V2<Vp<V1). The threshold value range in response to the peak value Vp of the detection signal associated with the third protrusion 19*c* is set as the low threshold value range (Vp<V2). For example, the peak value Vp is relatively high with the increase in the rotational speed of the crankshaft 5. In this case, the peak value Vp of the detection signal, which is outputted in the relatively early order to the rotation cycle of the crankshaft 5 and is associated with the first protrusion 19*a*, is adapted to the high threshold value range (V1<Vp). The decision is made that this time is the ignition timing for operating the spark plug 14 or the like. On the other hand, the peak value Vp is relatively low with the reduction in the rotational speed of the crankshaft 5. In this case, the peak value Vp of the detection signal, which is outputted in the relatively late order to the rotation cycle of the crankshaft 5 and is associated with the third protrusion 19*c*, is adapted to the low threshold value range (Vp<V2). The decision is made that this time is the ignition timing for operating the spark plug 14 or the like.

Accordingly, during the high-speed operation of the engine 1, the timing of the generation of the sparks by the spark plug 14 is relatively advanced. The timing of the ignition of the fuel-air mixture in the combustion chamber 7 is advanced. The combustion timing of the fuel-air mixture is thus adapted to the high-speed operation of the engine 1. On the other hand, during the low-speed operation of the engine 1, the timing of the generation of the sparks by the spark plug 14 or the like is relatively delayed. The timing of the ignition of the fuel-air mixture in the combustion chamber 7 is delayed. The combustion timing of the fuel-air mixture is thus adapted to the low-speed operation of the engine 1.

According to the ignition device of this embodiment, unlike the ignition device of the second prior art having the complicated large-sized drive mechanism and support mechanism, the ignition timing can be automatically controlled in the stable manner in response to the difference in the rotational speed of the engine 1 by the relatively simple constitution including the flywheel 6 having the protrusions 19*a*–19*c* and 20, a pair of magnet pickups 21 and 22 and the ECU 18.

Additionally, according to the ignition device of this embodiment, unlike the ignition device of the first prior art having the relatively narrow advance range of the ignition timing, the range of the alignment of the plural protrusions 19*a*–19*c* on the flywheel 6 is optionally set, whereby the ignition timing can be automatically controlled in the stable manner in response to the difference in the rotational speed of the engine 1 within the relatively wide variable range.

The ignition device of this embodiment needs the two magnet pickups 21 and 22 for applying the current to the ignition coil 15 and interrupting the current applied thereto. However, the second decision circuit 132 can be simplified. The circuit constitution of the ECU 18 can be relatively simple.

Moreover, the present invention can be embodied as described below within the scope of the appended claims without departing from the subject matter of the present invention.

Figure 26:
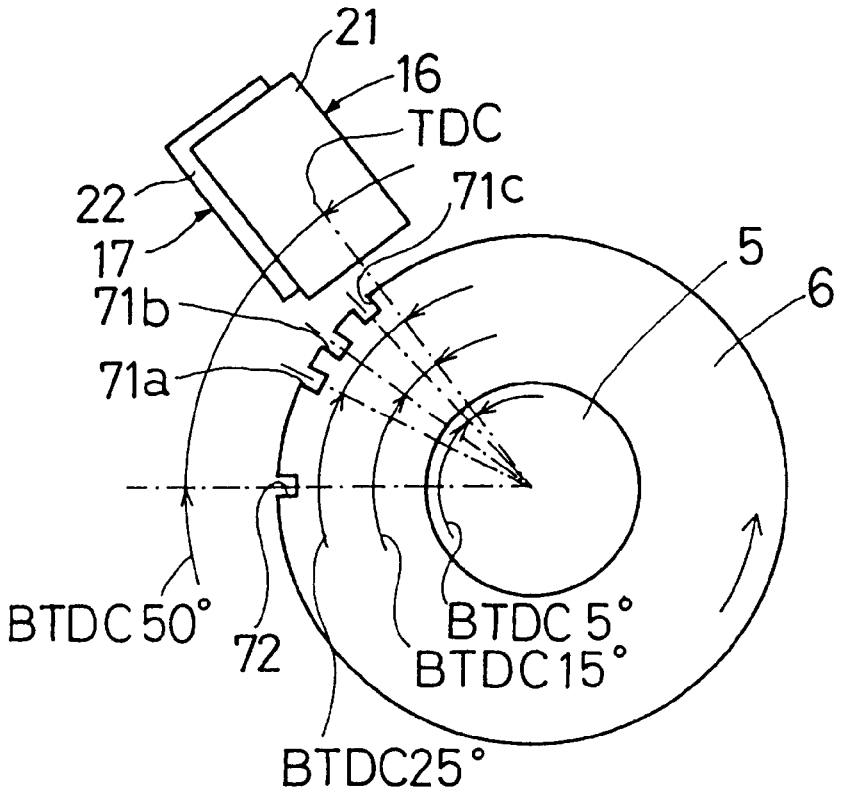
FIG. 26 is a conceptual front view showing arrangement of notches and magnet pickups on a flywheel in an additional embodiment.

In the above-mentioned embodiment, a plurality of protrusions 19*a*–19*c* and 20 are disposed on the outer periphery of the flywheel 6 so that they may correspond to the magnet pickups 21 and 22. Alternatively, as shown in FIG. 26, a plurality of notches 71*a*–71*c* and 72 may be disposed on the outer periphery of the flywheel 6 so that they may correspond to the magnet pickups 21 and 22.

Moreover, a detector will be described in detail. In FIG. 27(*a*), a driving pulley 203 is fixed on one end of a crankshaft 202 for transmitting a power of an engine 201 so as to drive an alternator, a cooling fan, etc. (not shown). A flywheel 204 is fixed on the other end of the crankshaft 202. A detector 241 (protrusion 241*a* or notch 241*c*) for detecting the position of rotation of the crankshaft is disposed on the circumference of the flywheel 204. A crank position sensor (magnet pickup sensor) 205 using an electromagnetic induction is fixed on the body of the engine 201 with a slight spacing between it and the detector 241. An example of the shape of the detector 241 is shown in FIG. 27(*b*), wherein the detector 241 is formed by integrating the protrusion 241*a* with the flywheel 204. FIG. 27(*e*) illustrates the constitution of the detector 241, wherein a detector component 241*b* is separately formed and then pressed into a key groove 204*a* formed on the circumference of the flywheel 204. In these cases, a width A of the detector component 241*a* or 241*b* can be formed so that it may be equal to or less than a width B of the flywheel 204. FIG. 27(*c*) shows the example in which the detector 241 is formed by forming the notch 241*c* on the circumference of the flywheel 204. FIG. 27(*d*) illustrates the constitution of the detector 241, wherein a separately formed detector component 241*d* is pressed into the circumference of the flywheel 204. FIG. 27(*f*) is a cross sectional view of FIG. 27(*d*). In FIG. 27(*f*), a leg 241*e* in the lower portion of the detector component 241*d* is pressed into a forcing hole 204*d* in the flywheel 204, so that the detector 241 is formed. In this case, a width C of the detector 241 can be formed so that it may be equal to or less than the width B of the flywheel 204. In the above examples, the detector is positioned on the circumference of the flywheel. However, as shown in FIGS. 27(*g*) and 27(*h*), the detector (protrusion 241*a* or notch 241*c*) may be disposed on the side of the circumference of the flywheel 204. As shown in FIG. 27(*i*), the crank position sensor 205 may be mounted on the surface facing the side of the detector 241 disposed on the side of the flywheel 204.

This invention is not limited to the above-described embodiments. This present can be embodied as described below within the scope of the appended claims without departing from the subject matter of the invention.

(1) Although the ignition device of the present invention is embodied in the single cylinder engine 1 in the above-described embodiments, the ignition device of the present invention can be also embodied in a multi-cylinder engine. In this case, the number of rotation sensors or the number of protrusions 19, 20 or notch 29 in the flywheel 6 may be increased in response to the number of cylinders. The number of ignition coil 15 and spark plug 14 may be also increased, and the electrical constitution of the ECU 18 or the like may be appropriately changed.

(2) In the third and fourth embodiments, the ignition timing is controlled in accordance with the rotational speed of the engine 1. However, the ignition timing can be also controlled in accordance with the rotational speed and load of the engine 1.

Figure 28:
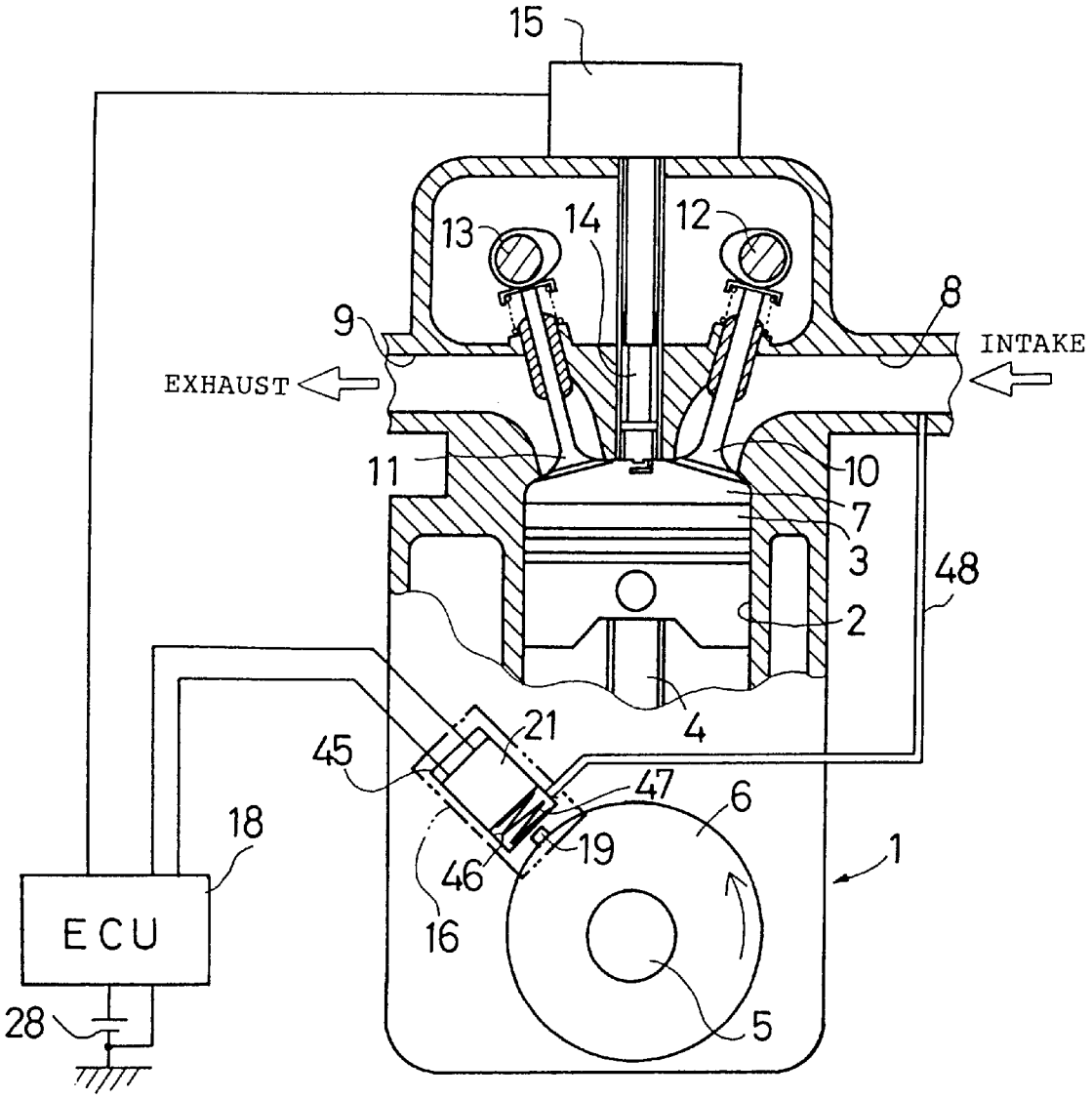
FIG. 28 is a schematic constitution showing an engine and an ignition device for the engine in an additional embodiment according to the present invention.

For example, as shown in FIG. 28, the magnet pickup 21 is contained in a container 45. A negative pressure chamber 46 is disposed between the end of the magnet pickup 21 and the container 45. A spring 47 is disposed in the negative pressure chamber 46. Furthermore, the negative pressure chamber 46 is communicated with the intake path 8 through a pipe 48. According to this constitution, when the engine 1 is operated under low load, an intake negative pressure introduced in the negative pressure chamber 46 via the pipe 48 is increased. The magnet pickup 21 is thus attracted toward the protrusion 19 against the force applied by the spring 47. Thereby, the level of the detection signal of the magnet pickup 21 is relatively high. On the other hand, when the engine 1 is operated under high load, the intake negative pressure introduced in the negative pressure chamber 46 via the pipe 48 is reduced. The magnet pickup 21 is thus separated from the protrusion 19 by the force applied by the spring 47. Thereby, the level of the detection signal of the magnet pickup 21 is relatively low. In this way, the timing when the detection signal exceeds the threshold value Vth, i.e., the ignition timing can be changed in accordance with the load of the engine 1 as well as the rotational speed of the engine 1.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An engine ignition device for igniting a fuel-air mixture supplied to an engine by emitting sparks to the fuel-air mixture by igniting means, the engine ignition device comprising:

a rotation detector for detecting a rotation of an output shaft of the engine at each predetermined rotational angle and for outputting a detection signal changed in response to a rotational speed of the output shaft; and a timing controller for changing an operating timing of the igniting means in accordance with the detection signal and for operating the igniting means in accordance with the changed operating timing;

wherein the rotation detector includes a protrusion in a flywheel on the output shaft and a magnetic pickup adjacent to a revolution locus of the protrusion, the magnetic pickup detecting a passage of the protrusion when the protrusion passes near the magnetic pickup, the magnetic pickup outputting a detection signal having a maximum value changed in proportion to a passing speed of the protrusion, and the timing controller includes a comparator circuit for operating the igniting means when a detection signal outputted from the magnetic pickup with the passage of the protrusion is larger than a predetermined threshold value.

2. The engine ignition device according to claim 1, wherein the igniting means includes a spark plug for emitting the sparks to the fuel-air mixture and an ignition coil for driving the spark plug, the ignition coil includes a primary coil and a secondary coil, the ignition coil provides the spark plug with a high voltage which is induced by the secondary coil when a current applied to the primary coil is interrupted, the timing controller includes an interrupting circuit for interrupting the current applied to the primary coil when the magnetic pickup detects the passage of the protrusion and the detection signal is higher than the threshold value, and the ignition device further includes a current applying device for starting the application of the current to the primary coil prior to the interruption of the current applied to the primary coil.

3. An engine ignition device for igniting a fuel-air mixture supplied to an engine by emitting sparks to the fuel-air mixture by igniting means, the engine ignition device comprising:

a rotation detector for detecting a rotation of an output shaft of the engine at each predetermined rotational angle and for outputting in a pulse manner a detection signal having a maximum value in response to a rotational speed of the output shaft; and a timing controller for changing an operating timing of the igniting means in accordance with a difference in the maximum value of the detection signal and for operating the igniting means in accordance with the changed operating timing.

4. The engine ignition device according to claim 3, wherein the rotation detector includes a protrusion in a flywheel on the output shaft and a magnet pickup adjacent to a revolution locus of the protrusion, the magnet pickup detects a passage of the protrusion when the protrusion passes near the magnet pickup, the magnet pickup outputs a detection signal having a maximum value changed in proportion to the passing speed of the protrusion, and the timing controller includes a comparator circuit for operating the igniting means when the detection signal outputted from the magnet pickup with the passage of the protrusion is larger than a predetermined threshold value.

5. The engine ignition device according to claim 4, wherein the timing controller includes a threshold value changing circuit for changing the threshold value to be compared to the detection signal, and the threshold value changing circuit changes the threshold value so that the threshold value may be relatively lower as the maximum value of the detection signal is higher.

6. The engine ignition device according to claim 4, wherein the igniting means includes a spark plug for emitting the sparks to the fuel-air mixture and an ignition coil for driving the spark plug, the ignition coil includes a primary coil and a secondary coil, the ignition coil provides the spark plug with a high voltage which is induced by the secondary coil when a current supplied to the primary coil is interrupted, the timing controller includes an interrupting circuit for interrupting the current applied to the primary coil when the magnet pickup detects the passage of the protrusion and the detection signal is higher than the threshold value, and the ignition device further includes a current applying device for starting the application of the current to the primary coil prior to the interruption of the current applied to the primary coil.

7. The engine ignition device according to claim 3, wherein the rotation detector includes a notch in a flywheel on the output shaft and a magnet pickup adjacent to a revolution locus of the notch, the magnet pickup detects a passage of the notch when the notch passes near the magnet pickup, the magnet pickup outputs a detection signal having a maximum value changed in proportion to the passing speed of the notch, and the timing controller includes a comparator circuit for operating the igniting means when the detection signal outputted from the magnet pickup with the passage of the notch is larger than a predetermined threshold value.

8. The engine ignition device according to claim 7, wherein the timing controller includes a threshold value changing circuit for changing the threshold value to be compared to the detection signal, and the threshold value changing circuit changes the threshold value so that the threshold value may be relatively lower as the maximum value of the detection signal is higher.

9. The engine ignition device according to claim 7, wherein the igniting means includes a spark plug for emitting the sparks to the fuel-air mixture and an ignition coil for driving the spark plug, the ignition coil includes a primary coil and a secondary coil, the ignition coil provides the spark plug with a high voltage which is induced by the secondary coil when a current supplied to the primary coil is interrupted, the timing controller includes an interrupting circuit for interrupting the current applied to the primary coil when the magnet pickup detects the passage of the notch and the detection signal is higher than the threshold value, and the ignition device further includes a current applying device for starting the application of the current to the primary coil prior to the interruption of the current applied to the primary coil.

10. The engine ignition device according to claim 3, further comprising a detector disposed on a circumference or periphery of a flywheel on the output shaft so that the detector detects a rotational position of the output shaft.

11. The engine ignition device according to claim 10, wherein the detector includes a protrusion and a magnet pickup adjacent to a revolution locus of the protrusion, the magnet pickup detects a passage of the protrusion when the protrusion passes near the magnet pickup, the magnet pickup outputs a detection signal having a maximum value changed in proportion to the passing speed of the protrusion.

12. The engine ignition device according to claim 10, wherein the detector includes a recess and a magnet pickup adjacent to a revolution locus of the recess, the magnet pickup detects a passage of the recess when the recess passes near the magnet pickup, the magnet pickup outputs a detection signal having a maximum value changed in proportion to the passing speed of the recess.

13. The engine ignition device according to claim 3, wherein the rotation detector intermittently detects the rotation at each of a plurality of preset rotational angles and sequentially outputs detection signals, the controller monitors the maximum values of the sequentially outputted detection signals, the controller decides an ignition timing in this rotation cycle of the output shaft when it determines that the maximum value has a magnitude which is previously set in response to the order of output, and the controller controls the igniting means in accordance with the ignition timing.

14. The engine ignition device according to claim 13, wherein the rotation detector includes a plurality of protrusions in the flywheel on the output shaft and a magnet pickup adjacent to the revolution locus of the protrusions, the magnet pickup detects the passage of the protrusions when the protrusions pass near the magnet pickup, the magnet pickup sequentially outputs a plurality of detection signals having maximum values proportional to the passing speed of the protrusions, the timing controller includes a decision circuit, the decision circuit compares the maximum values of the detection signals sequentially outputted from the magnet pickup due to the passage of the protrusions to threshold value ranges which are previously set in response to the order of output, and the decision circuit decides an operating timing for operating the igniting means when the maximum value is adapted to the threshold value range.

15. The engine ignition device according to claim 14, wherein the igniting means includes a spark plug for emitting the sparks to the fuel-air mixture and an ignition coil for driving the spark plug, the ignition coil includes a primary coil and a secondary coil, the ignition coil provides the spark plug with the high voltage which is induced by the secondary coil when the current supplied to the primary coil is interrupted, the timing controller includes an interrupting circuit for interrupting the current applied to the primary coil when the decision circuit decides the operating timing, and the ignition device further includes a current applying device for starting the application of the current to the primary coil prior to the interruption of the current applied to the primary coil.

16. The engine ignition device according to claim 13, wherein the rotation detector includes a plurality of notches in the flywheel on the output shaft and a magnet pickup adjacent to the revolution locus of the notches, the magnet pickup detects the passage of the notches when the notches pass near the magnet pickup, the magnet pickup sequentially outputs a plurality of detection signals having maximum values proportional to the passing speed of the notches, the timing controller includes a decision circuit, the decision circuit compares the maximum values of the detection signals sequentially outputted from the magnet pickup due to the passage of the notches to threshold value ranges which are previously set in response to the order of output, and the decision circuit decides an operating timing for operating the igniting means the maximum value is adapted to the threshold value range.

17. The engine ignition device according to claim 16, wherein the igniting means includes a spark plug for emitting the sparks to the fuel-air mixture and an ignition coil for driving the spark plug, the ignition coil includes a primary coil and a secondary coil, the ignition coil provides the spark plug with the high voltage which is induced by the secondary coil when the current supplied to the primary coil is interrupted, the timing controller includes an interrupting circuit for interrupting the current applied to the primary coil when the decision circuit decides the operating timing, and the ignition device further includes a current applying device for starting the application of the current to the primary coil prior to the interruption of the current applied to the primary coil.

* * * * *

UNITED STATES PATENT AND TRADEMARK OFFICE

CERTIFICATE OF CORRECTION

PATENT NO. : 6,192,861 B1
DATED : February 27, 2001
INVENTOR(S) : Hamada et al.

It is certified that error appears in the above-identified patent and that said Letters Patent is hereby corrected as shown below:

Column 28,
Line 10, after "igniting means", insert -- when --.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*